US011162353B2

(12) United States Patent
Thiruvenkatanathan

(10) Patent No.: US 11,162,353 B2
(45) Date of Patent: Nov. 2, 2021

(54) SYSTEMS AND METHODS FOR DRAW DOWN IMPROVEMENTS ACROSS WELLBORES

(71) Applicant: Lytt Limited, Middlesex (GB)

(72) Inventor: Pradyumna Thiruvenkatanathan, London (GB)

(73) Assignee: LYTT LIMITED, Middlesex (GB)

( * ) Notice: Subject to any disclaimer, the term of this patent is extended or adjusted under 35 U.S.C. 154(b) by 0 days.

(21) Appl. No.: 17/091,940

(22) Filed: Nov. 6, 2020

(65) Prior Publication Data

US 2021/0148199 A1 May 20, 2021

(30) Foreign Application Priority Data

Nov. 15, 2019 (WO) ..... PCT/EP2019/081542

(51) Int. Cl.
*E21B 47/107* (2012.01)
*E21B 47/135* (2012.01)
(Continued)

(52) U.S. Cl.
CPC ..... *E21B 47/107* (2020.05); *E21B 43/12* (2013.01); *E21B 43/121* (2013.01); *E21B 47/10* (2013.01);
(Continued)

(58) Field of Classification Search
CPC ..... E21B 43/12; E21B 43/14; E21B 47/10; E21B 47/107; E21B 47/135; E21B 2200/22
See application file for complete search history.

(56) References Cited

U.S. PATENT DOCUMENTS 3,563,311 A 2/1971 Stein
3,841,144 A 10/1974 Baldwin
(Continued)

FOREIGN PATENT DOCUMENTS

CA 2760662 A1 12/2010
CA 2953938 A1 1/2016
(Continued)

OTHER PUBLICATIONS

PCT/EP2019/081542 International Search Report and Written Opinion dated Jul. 24, 2020 (501438) (15 p.).
(Continued)

*Primary Examiner* — Tara Schimpf
(74) *Attorney, Agent, or Firm* — Conley Rose, P.C.

(57) ABSTRACT

A method for determining an operating envelope for a wellbore can include receiving an indication of a hydrocarbon production rate of a hydrocarbon fluid into the wellbore from at least one production zone, receiving an indication of a fluid production rate of a fluid into the wellbore from the at least one production zone, receiving an indication of a pressure within the wellbore while producing the one or more fluids from the wellbore from the at least one production zone, correlating the indication of the pressure with the hydrocarbon production rate and the fluid production rate, and determining an operating envelope based on the correlating. The fluid production rate comprises at least one of: an aqueous fluid production rate or a gas production rate. The operating envelope defines a boundary for the indication of the pressure, the fluid production rate, and the hydrocarbon production rate.

27 Claims, 6 Drawing Sheets

(51) Int. Cl.
*E21B 43/12* (2006.01)
*E21B 47/10* (2012.01)

(52) U.S. Cl.
CPC ..... *E21B 47/135* (2020.05); *E21B 2200/20* (2020.05); *E21B 2200/22* (2020.05)

(56) References Cited

U.S. PATENT DOCUMENTS 3,854,323 A 12/1974 Hearn et al.
5,042,297 A 8/1991 Lessi
5,113,941 A 5/1992 Donovan
5,257,530 A 11/1993 Beattie et al.
5,812,493 A 9/1998 Robein et al.
5,825,017 A 10/1998 Pryor
5,971,095 A 10/1999 Ozbek
6,075,611 A 6/2000 Dussan V. et al.
6,151,556 A 11/2000 Allen
6,201,765 B1 3/2001 Ireson
6,450,037 B1 9/2002 McGuinn et al.
6,501,067 B2 12/2002 Jones et al.
6,516,275 B2 2/2003 Lazaratos
6,550,342 B2 4/2003 Croteau et al.
6,555,807 B2 4/2003 Clayton et al.
6,587,798 B2 7/2003 Kersey et al.
6,601,458 B1 8/2003 Gysling et al.
6,601,671 B1 8/2003 Zhao et al.
6,651,007 B2 11/2003 Ozbek
6,672,131 B1 1/2004 Aldal et al.
6,738,715 B2 5/2004 Shatilo et al.
6,751,559 B2 6/2004 Fookes et al.
6,782,150 B2 8/2004 Davis et al.
6,813,403 B2 11/2004 Tennyson
6,829,538 B2 12/2004 de Kok
6,837,098 B2 1/2005 Gysling et al.
6,904,368 B2 6/2005 Reshef et al.
6,933,491 B2 8/2005 Maida, Jr.
7,028,543 B2 4/2006 Hardage et al.
7,030,971 B1 4/2006 Payton
7,072,044 B2 7/2006 Kringlebotn et al.
7,088,639 B2 8/2006 Walls et al.
7,130,496 B2 10/2006 Rogers
7,219,762 B2 5/2007 James et al.
7,355,923 B2 4/2008 Reshef et al.
7,357,021 B2 4/2008 Blacklaw
7,395,864 B2 7/2008 Ramachandran et al.
7,398,697 B2 7/2008 Allen et al.
7,404,456 B2 7/2008 Weaver et al.
7,503,217 B2 3/2009 Johansen
7,652,245 B2 1/2010 Crickmore et al.
7,659,828 B2 2/2010 Wehrs et al.
7,660,200 B2 2/2010 Tang
7,872,736 B2 1/2011 Rogers et al.
7,890,280 B2 2/2011 Fomme
7,896,069 B2 3/2011 Dria et al.
7,940,389 B2 5/2011 Rogers et al.
7,946,341 B2 5/2011 Hartog et al.
8,020,616 B2 9/2011 Greenaway
8,023,829 B2 9/2011 Nash et al.
8,131,121 B2 3/2012 Huffman
8,200,049 B2 6/2012 Kaplan et al.
8,245,780 B2 8/2012 Fidan et al.
8,248,589 B2 8/2012 DeFreitas et al.
8,264,676 B2 9/2012 Kanellopoulos et al.
8,408,064 B2 4/2013 Hartog et al.
8,520,197 B2 8/2013 Handerek
8,534,114 B2 9/2013 Ellson
8,564,786 B2 10/2013 Crickmore et al.
8,576,386 B2 11/2013 Jones et al.
8,605,542 B2 12/2013 Coates et al.
8,614,795 B2 12/2013 Duncan et al.
8,634,681 B2 1/2014 Rogers
8,661,907 B2 3/2014 Davis et al.
8,755,643 B2 6/2014 Nash et al.
8,797,824 B2 8/2014 Crickmore et al.
8,902,704 B2 12/2014 Zamow et al.
8,923,663 B2 12/2014 Hill et al.
8,941,821 B2 1/2015 Coupe et al.
8,950,482 B2 2/2015 Hill et al.
8,973,444 B2 3/2015 Hill et al.
8,996,298 B2 3/2015 Yamada
8,997,585 B2 4/2015 Hayward
9,002,149 B2 4/2015 Rogers
9,052,230 B2 6/2015 Kutlik et al.
9,075,155 B2 7/2015 Luscombe et al.
9,109,944 B2 8/2015 Den Boer et al.
9,110,018 B2 8/2015 Handerek
9,140,582 B2 9/2015 Farhadiroushan et al.
9,140,815 B2 9/2015 Lopez et al.
9,146,151 B2 9/2015 Kupershmidt
9,228,889 B2 1/2016 McCann
9,243,949 B2 1/2016 Crickmore et al.
9,250,112 B2 2/2016 Godfrey
9,250,120 B2 2/2016 Smith et al.
9,255,836 B2 2/2016 Taverner et al.
9,304,017 B2 4/2016 Handerek
9,341,731 B2 5/2016 Biswas
9,347,313 B2 5/2016 Wills et al.
9,354,338 B1 5/2016 Psaila
9,377,551 B2 6/2016 Hartog et al.
9,377,559 B2 6/2016 Cooper
9,388,685 B2 7/2016 Ravi et al.
9,416,644 B2 8/2016 McEwen-King et al.
9,423,523 B2 8/2016 McEwen-King
9,429,466 B2 8/2016 Barfoot et al.
9,430,507 B2 8/2016 Stowe et al.
9,435,668 B2 9/2016 Lewis et al.
9,435,902 B2 9/2016 Hill et al.
9,453,821 B2 9/2016 Minto et al.
9,459,329 B2 10/2016 McEwen-King et al.
9,465,126 B2 10/2016 Lewis et al.
9,478,937 B1 10/2016 Kupershmidt et al.
9,507,030 B2 11/2016 Godfrey
9,512,711 B2 12/2016 Sobolewski et al.
9,523,790 B1 12/2016 Valishin
9,541,425 B2 1/2017 Farhadiroushan et al.
9,557,195 B2 1/2017 Barfoot et al.
9,561,812 B2 2/2017 Godfrey
9,575,196 B2 2/2017 Ji et al.
9,594,002 B2 3/2017 Godfrey et al.
9,599,489 B2 3/2017 Nash et al.
9,605,537 B2 3/2017 Hull et al.
9,606,250 B2 3/2017 Hull et al.
9,625,348 B2 4/2017 Hill et al.
9,631,972 B2 4/2017 Hill et al.
9,651,474 B2 5/2017 Farhadiroushan et al.
9,651,709 B2 5/2017 Jaaskelainen
9,677,956 B2 6/2017 Hill et al.
9,702,244 B2 7/2017 Willis et al.
9,719,846 B2 8/2017 Ellmauthaler et al.
9,733,120 B2 8/2017 Stokely et al.
9,739,645 B2 8/2017 Hill et al.
9,746,393 B2 8/2017 Godfrey
9,759,824 B2 9/2017 Lumens et al.
9,766,371 B2 9/2017 Barfoot et al.
9,778,097 B2 10/2017 McEwen-King
9,784,642 B2 10/2017 Strong et al.
9,797,239 B2 10/2017 Godfrey
9,810,809 B2 11/2017 Farhadiroushan et al.
9,816,853 B2 11/2017 Crickmore et al.
9,823,114 B2 11/2017 Farhadiroushan et al.
9,829,368 B2 11/2017 Kutlik et al.
9,850,749 B2 12/2017 Finfer et al.
9,869,795 B2 1/2018 Jaaskelainen
9,880,047 B2 1/2018 Martin et al.
9,896,929 B2 2/2018 Farhadiroushan et al.
9,909,903 B2 3/2018 Lewis et al.
9,945,215 B2 4/2018 Godfrey
9,945,979 B2 4/2018 Stokely et al.
9,983,293 B2 5/2018 Farhadiroushan et al.
9,989,388 B2 6/2018 Farhadiroushan et al.
10,018,036 B2 7/2018 Ellmauthaler et al.
10,031,044 B2 7/2018 Kumar et al.
10,067,030 B2 9/2018 Hartog et al.
10,101,182 B2 10/2018 Barfoot

(56) References Cited

U.S. PATENT DOCUMENTS 10,120,104 B2 11/2018 Roy et al.
10,139,268 B2 11/2018 Nunes et al.
10,145,821 B2 12/2018 Farhadiroushan et al.
10,151,626 B2 12/2018 Godfrey et al.
10,175,374 B2 1/2019 Dusterhoft et al.
10,180,515 B2 1/2019 Ellmauthaler et al.
10,197,693 B2 2/2019 Kalyanraman et al.
10,198,946 B2 2/2019 Crickmore et al.
10,215,017 B2 2/2019 Hull et al.
10,221,681 B2 3/2019 McEwen-King et al.
10,234,345 B2 3/2019 Hull et al.
10,247,584 B2 4/2019 Crickmore et al.
10,260,937 B2 4/2019 Dankers et al.
10,267,141 B2 4/2019 Nunes et al.
10,274,381 B2 4/2019 Kulkarni et al.
10,275,402 B2 4/2019 Guerriero et al.
10,281,341 B2 5/2019 Hull et al.
10,310,113 B2 6/2019 Sun et al.
10,317,262 B2 6/2019 Kippersund et al.
10,379,239 B2 8/2019 Udengaard
10,393,921 B2 8/2019 Cuny et al.
10,401,519 B2 9/2019 Willis et al.
10,416,328 B2 9/2019 Walters et al.
10,422,365 B2 9/2019 Hull et al.
10,422,901 B2 9/2019 Walters et al.
10,429,530 B2 10/2019 Rickett et al.
10,444,388 B2 10/2019 Dusterhoft et al.
10,444,391 B2 10/2019 Ellmauthaler et al.
10,444,393 B2 10/2019 Cheng et al.
10,458,224 B2 10/2019 Dickenson et al.
10,520,625 B2 12/2019 Walters et al.
10,578,757 B2 3/2020 Dong et al.
2001/0037883 A1 11/2001 Veneruso et al.
2002/0195246 A1 6/2002 Davidson
2002/0125009 A1* 9/2002 Wetzel ..... E21B 23/00 166/278
2002/0139929 A1 10/2002 Mullins et al.
2003/0010126 A1 1/2003 Romanet et al.
2003/0014199 A1 1/2003 Toomey
2003/0029241 A1 2/2003 Mandal
2004/0059505 A1 3/2004 Gallagher
2004/0252748 A1* 12/2004 Gleitman ..... E21B 47/135 374/130
2005/0100172 A1 5/2005 Schliep et al.
2005/0246111 A1 11/2005 Gysling et al.
2006/0113089 A1* 6/2006 Henriksen ..... E21B 34/08 166/386
2006/0165239 A1 7/2006 Langner et al.
2006/0165344 A1 7/2006 Mendez et al.
2007/0047867 A1 3/2007 Goldner
2007/0163780 A1 7/2007 Onodera et al.
2007/0199696 A1 8/2007 Walford
2007/0215345 A1 9/2007 Lafferty et al.
2007/0234789 A1 10/2007 Glasbergen et al.
2007/0247631 A1 10/2007 Paulson
2007/0253561 A1 11/2007 Williams et al.
2008/0137475 A1 6/2008 Maisons
2008/0154510 A1 6/2008 Scott
2008/0232748 A1 9/2008 Nash
2008/0314142 A1 12/2008 Davies
2009/0010104 A1 1/2009 Leaney
2009/0055098 A1 2/2009 Mese et al.
2009/0132183 A1 5/2009 Hartog et al.
2009/0202192 A1 8/2009 Taverner et al.
2009/0213692 A1 8/2009 Martinez et al.
2010/0163223 A1 7/2010 Brown
2010/0243241 A1 9/2010 Hampton et al.
2010/0258304 A1 10/2010 Hegeman
2010/0268489 A1 10/2010 Lie et al.
2011/0030467 A1 2/2011 Bakulin
2011/0042071 A1 2/2011 Hsu et al.
2011/0085415 A1 4/2011 Morton et al.
2011/0110191 A1 5/2011 Williams-Stroud et al.
2011/0139538 A1 6/2011 Hill et al.
2011/0149688 A1 6/2011 Hill et al.
2011/0188346 A1 8/2011 Hull
2011/0255077 A1 10/2011 Rogers
2011/0301882 A1 12/2011 Andersen
2011/0315369 A1 12/2011 Holderman et al.
2012/0020184 A1 1/2012 Wilson et al.
2012/0043079 A1 2/2012 Wassouf et al.
2012/0057432 A1 3/2012 Hill et al.
2012/0092960 A1 4/2012 Gaston et al.
2012/0096922 A1 4/2012 Ellson
2012/0111560 A1 5/2012 Hill et al.
2012/0137781 A1 6/2012 Hill et al.
2012/0152024 A1 6/2012 Johansen
2012/0155218 A1 6/2012 Beasley et al.
2012/0257475 A1 10/2012 Luscombe et al.
2012/0290213 A1 11/2012 Huo et al.
2013/0139600 A1 6/2013 McEwen-King et al.
2013/0151203 A1 6/2013 McEwen-King et al.
2013/0166227 A1 6/2013 Hermann et al.
2013/0167628 A1 7/2013 Hull et al.
2013/0170519 A1 7/2013 Alliot
2013/0298665 A1 11/2013 Minchau
2013/0299165 A1 11/2013 Crow
2013/0319121 A1 12/2013 Hill et al.
2014/0025319 A1 1/2014 Farhadiroushan et al.
2014/0036627 A1 2/2014 Hull et al.
2014/0036628 A1 2/2014 Hill et al.
2014/0069173 A1 3/2014 Roy et al.
2014/0086009 A1 3/2014 Yoneshima
2014/0150523 A1 6/2014 Stokely et al.
2014/0150548 A1 6/2014 Childers et al.
2014/0204368 A1 7/2014 Lewis et al.
2014/0216151 A1 8/2014 Godfrey et al.
2014/0334253 A1 11/2014 Lumens et al.
2014/0362668 A1 12/2014 McEwen-King
2015/0000415 A1 1/2015 Kelley
2015/0085610 A1 3/2015 Raum et al.
2015/0144333 A1 5/2015 Lee et al.
2015/0146759 A1 5/2015 Johnston
2015/0234526 A1 8/2015 Chalubert et al.
2015/0235544 A1 8/2015 Hernandez et al.
2015/0308909 A1 10/2015 Carneal et al.
2016/0123798 A1 5/2016 Godfrey et al.
2016/0138386 A1 5/2016 Stokely et al.
2016/0146962 A1 5/2016 Hayward
2016/0223389 A1 8/2016 Farhadiroushan et al.
2016/0259079 A1 9/2016 Wilson et al.
2016/0265345 A1 9/2016 In T Panhuis et al.
2016/0281494 A1 9/2016 Shirdel et al.
2016/0312552 A1 10/2016 Early et al.
2016/0312604 A1 10/2016 Hull et al.
2016/0327419 A1 11/2016 Hellevang et al.
2016/0342569 A1 11/2016 Al Marzouqi
2016/0356665 A1 12/2016 Felemban et al.
2016/0369590 A1* 12/2016 Tonkin ..... E21B 43/12
2016/0369607 A1 12/2016 Roy et al.
2017/0010385 A1 1/2017 Englich et al.
2017/0016312 A1 1/2017 Clarke et al.
2017/0039826 A1 2/2017 Cojocaur
2017/0045410 A1 2/2017 Crickmore et al.
2017/0052049 A1 2/2017 Crickmore et al.
2017/0052050 A1 2/2017 Crickmore et al.
2017/0074998 A1 3/2017 McColpin et al.
2017/0074999 A1 3/2017 Walters et al.
2017/0075001 A1 3/2017 McColpin et al.
2017/0075002 A1 3/2017 Ranjan et al.
2017/0075003 A1 3/2017 Dusterhoft et al.
2017/0075004 A1 3/2017 McColpin et al.
2017/0075005 A1 3/2017 Ranjan et al.
2017/0082766 A1 3/2017 Milne et al.
2017/0119255 A1 5/2017 Mahajan et al.
2017/0123089 A1 5/2017 Walters et al.
2017/0153154 A1 6/2017 Hull et al.
2017/0205253 A1 7/2017 Handerek
2017/0241830 A1 8/2017 Jaaskelainen
2017/0241831 A1 8/2017 Jaaskelainen
2017/0275986 A1 9/2017 Nunes et al.
2017/0292862 A1 10/2017 Godfrey
2017/0315261 A1 11/2017 Bartling et al.
2017/0342814 A1 11/2017 Krueger et al.

(56) References Cited

U.S. PATENT DOCUMENTS

| | | | |
|---|---|---|---|
| 2017/0343389 | A1 | 11/2017 | Parker et al. |
| 2017/0350234 | A1 | 12/2017 | Xia et al. |
| 2017/0363756 | A1 | 12/2017 | El Allouche et al. |
| 2017/0371057 | A1 | 12/2017 | Mateeva et al. |
| 2018/0024260 | A1 | 1/2018 | Hornman et al. |
| 2018/0031413 | A1 | 2/2018 | Stokely et al. |
| 2018/0045543 | A1 | 2/2018 | Farhadiroushan et al. |
| 2018/0045768 | A1 | 2/2018 | Godfrey et al. |
| 2018/0058196 | A1 | 3/2018 | Jaaskelainen et al. |
| 2018/0066490 | A1 | 3/2018 | Kjos |
| 2018/0087372 | A1 | 3/2018 | Stokely et al. |
| 2018/0094952 | A1 | 4/2018 | Handerek |
| 2018/0112519 | A1 | 4/2018 | Duan et al. |
| 2018/0112520 | A1 | 4/2018 | Duan |
| 2018/0112523 | A1 | 4/2018 | Yang et al. |
| 2018/0136354 | A1 | 5/2018 | Haldorsen |
| 2018/0172860 | A1 | 6/2018 | Wilson et al. |
| 2018/0180658 | A1 | 6/2018 | Godfrey |
| 2018/0203144 | A1 | 7/2018 | Karrenbach et al. |
| 2018/0222498 | A1 | 8/2018 | Kelley |
| 2018/0224572 | A1 | 8/2018 | Farhadiroushan et al. |
| 2018/0230797 | A1 | 8/2018 | Seshadri et al. |
| 2018/0231658 | A1 | 8/2018 | Jalilian et al. |
| 2018/0238167 | A1 | 8/2018 | Ravi et al. |
| 2018/0252097 | A1 | 9/2018 | Skinner et al. |
| 2018/0259662 | A1 | 9/2018 | Srinivasan |
| 2018/0266854 | A1 | 9/2018 | Moore et al. |
| 2018/0267201 | A1 | 9/2018 | Lewis |
| 2018/0284752 | A1 | 10/2018 | Cella et al. |
| 2018/0292569 | A1 | 10/2018 | LeBlanc et al. |
| 2018/0320827 | A1 | 11/2018 | Hull et al. |
| 2018/0340801 | A1 | 11/2018 | Kelley et al. |
| 2018/0342156 | A1 | 11/2018 | Martin et al. |
| 2018/0354534 | A1 | 12/2018 | Cole |
| 2018/0356210 | A1 | 12/2018 | Moore et al. |
| 2019/0003499 | A1 | 1/2019 | Logan et al. |
| 2019/0003903 | A1 | 1/2019 | Godfrey |
| 2019/0025094 | A1 | 1/2019 | Lewis et al. |
| 2019/0026634 | A1 | 1/2019 | Homeyer et al. |
| 2019/0064030 | A1 | 2/2019 | Sundermann |
| 2019/0072379 | A1 | 3/2019 | Jalilian et al. |
| 2019/0113641 | A1 | 4/2019 | Fang et al. |
| 2019/0120044 | A1 | 4/2019 | Langnes et al. |
| 2019/0137045 | A1 | 5/2019 | Jalilian et al. |
| 2019/0169985 | A1 | 6/2019 | Dickenson et al. |
| 2019/0186958 | A1 | 6/2019 | Godfrey |
| 2019/0197846 | A1 | 6/2019 | Englund |
| 2019/0225250 | A1 | 7/2019 | Esprey et al. |
| 2019/0257169 | A1 | 8/2019 | Grimsbo et al. |
| 2019/0257699 | A1 | 8/2019 | Handerek et al. |
| 2019/0323863 | A1 | 10/2019 | Shatalin et al. |
| 2019/0324444 | A1 | 10/2019 | Cella et al. |
| 2019/0331819 | A1 | 10/2019 | Wu et al. |
| 2019/0339688 | A1 | 11/2019 | Cella et al. |
| 2019/0353814 | A1 | 11/2019 | Cha et al. |
| 2019/0390546 | A1 | 12/2019 | Langnes et al. |
| 2020/0018149 | A1 | 1/2020 | Luo et al. |
| 2020/0024942 | A1 | 1/2020 | Lolla et al. |
| 2020/0032639 | A1 | 1/2020 | Langnes et al. |
| 2020/0032645 | A1 | 1/2020 | LeBlanc et al. |
| 2020/0048999 | A1 | 2/2020 | Langnes et al. |
| 2020/0056907 | A1 | 2/2020 | Godfrey |
| 2020/0057220 | A1 | 2/2020 | Hull et al. |
| 2020/0070862 | A1 | 3/2020 | Bilodeau et al. |
| 2020/0081145 | A1 | 3/2020 | Padhi et al. |
| 2020/0088022 | A1 | 3/2020 | Shen et al. |
| 2020/0102821 | A1 | 4/2020 | Willis et al. |
| 2020/0124489 | A1 | 4/2020 | Godfrey |
| 2020/0131900 | A1 | 4/2020 | Leblanc et al. |
| 2020/0158594 | A1 | 5/2020 | Dankers et al. |
| 2020/0172130 | A1 | 6/2020 | Esprey |
| 2020/0173273 | A1 | 6/2020 | Thiruvenkatanathan |
| 2020/0173818 | A1 | 6/2020 | Handerek et al. |
| 2020/0174149 | A1 | 6/2020 | Thiruvenkatanathan |
| 2020/0182047 | A1 | 6/2020 | Langnes et al. |
| 2020/0184556 | A1 | 6/2020 | Cella |
| 2020/0190971 | A1 | 6/2020 | Thiruvenkatanathan |
| 2020/0200000 | A1 | 6/2020 | Langnes et al. |
| 2020/0200943 | A1 | 6/2020 | Adeyemi et al. |
| 2020/0233107 | A1 | 7/2020 | Constantinou et al. |
| 2020/0256834 | A1 | 8/2020 | Langnes et al. |
| 2020/0291772 | A1 | 9/2020 | Thiruvenkatanathan et al. |
| 2021/0047916 | A1 | 2/2021 | Thiruvenkatanathan et al. |

FOREIGN PATENT DOCUMENTS

| | | | |
|---|---|---|---|
| CA | 2866274 | A1 | 3/2016 |
| CN | 101769442 | A | 7/2010 |
| CN | 102226390 | A | 10/2011 |
| CN | 203561437 | U | 4/2014 |
| CN | 105135219 | A | 12/2015 |
| CN | 105676267 | A | 6/2016 |
| CN | 205746047 | U | 11/2016 |
| CN | 108918405 | A | 11/2018 |
| CN | 109000157 | A | 12/2018 |
| CN | 110231409 | A | 9/2019 |
| CN | 209858753 | U | 12/2019 |
| EP | 2418466 | A2 | 2/2012 |
| EP | 3006908 | A1 | 4/2016 |
| EP | 3032441 | A2 | 6/2016 |
| EP | 3073051 | A1 | 9/2016 |
| EP | 3314308 | A1 | 5/2018 |
| EP | 3440314 | A2 | 2/2019 |
| GB | 1299843 | A | 12/1972 |
| GB | 2354782 | A | 4/2001 |
| GB | 2359834 | A | 9/2001 |
| GB | 2522061 | A | 7/2015 |
| GB | 2555550 | A | 5/2018 |
| GB | 2555637 | A | 5/2018 |
| JP | 5518424 | B2 | 5/2018 |
| NL | 9000577 | A | 10/1990 |
| WO | 9721116 | A1 | 6/1997 |
| WO | 2004031738 | A1 | 4/2004 |
| WO | 2007024763 | A2 | 3/2007 |
| WO | 2008/147953 | A1 | 12/2008 |
| WO | 2009048340 | A2 | 4/2009 |
| WO | 2009086279 | A2 | 7/2009 |
| WO | 2009109747 | A1 | 9/2009 |
| WO | 2010099484 | A2 | 9/2010 |
| WO | 2012011831 | A1 | 1/2012 |
| WO | 2013114135 | A2 | 8/2013 |
| WO | 2015011394 | A1 | 1/2015 |
| WO | 2015025216 | A2 | 2/2015 |
| WO | 2015060981 | A1 | 4/2015 |
| WO | 2015170113 | A1 | 11/2015 |
| WO | 2015170116 | A1 | 11/2015 |
| WO | 2016010550 | A1 | 1/2016 |
| WO | 2016020654 | A1 | 2/2016 |
| WO | 2016115030 | A1 | 7/2016 |
| WO | 2016207341 | A1 | 12/2016 |
| WO | 2017009606 | A1 | 1/2017 |
| WO | 2017064472 | A1 | 4/2017 |
| WO | 2017078536 | A1 | 5/2017 |
| WO | 2017109467 | A1 | 6/2017 |
| WO | 2017156339 | A1 | 9/2017 |
| WO | 2017174746 | A1 | 10/2017 |
| WO | 2017174750 | A2 | 10/2017 |
| WO | 2017203271 | A1 | 11/2017 |
| WO | 2017214729 | A1 | 12/2017 |
| WO | 2018044309 | A1 | 3/2018 |
| WO | 2018057029 | A1 | 3/2018 |
| WO | 2018088994 | A1 | 5/2018 |
| WO | 2018136050 | A1 | 7/2018 |
| WO | 2018154275 | A1 | 8/2018 |
| WO | 2018178279 | A1 | 10/2018 |
| WO | 2018195661 | A1 | 11/2018 |
| WO | 2019005050 | A1 | 1/2019 |
| WO | 2019027466 | A1 | 2/2019 |
| WO | 2019038401 | A1 | 2/2019 |
| WO | 2019072899 | A2 | 4/2019 |
| WO | 2019094140 | A1 | 5/2019 |
| WO | 2019094474 | A1 | 5/2019 |
| WO | 2019136556 | A1 | 7/2019 |
| WO | 2019139564 | A1 | 7/2019 |

(56) References Cited

FOREIGN PATENT DOCUMENTS

| | | | |
|---|---|---|---|
| WO | 2020109426 | A2 | 6/2020 |
| WO | 2020109427 | A2 | 6/2020 |
| WO | 2020119957 | A1 | 6/2020 |
| WO | 2021037586 | A1 | 3/2021 |

OTHER PUBLICATIONS

Abukhamsin, Ahmed Yasin, "Inflow Profiling and Production Optimization in Smart Wells Using Distributed Acoustic and Temperature Measurements," (https://pangea.stanford.edu/ERE/pdf/pereports/PhD/Abukhamsin2016.pdf) (193 p.).
Restriction Requirement dated Dec. 15, 2020, U.S. Appl. No. 16/291,929, filed Oct. 5, 2018.
Office Action dated Dec. 4, 2019, U.S. Appl. No. 16/563,689, filed Sep. 6, 2019.
Notice of Allowance dated May 20, 2020, U.S. Appl. No. 16/563,689, filed Sep. 6, 2019.
Corrected Notice of Allowability dated Jun. 19, 2020, U.S. Appl. No. 16/563,689, filed Sep. 6, 2019.
European Search Report dated Apr. 22, 2020, for European Application No. 20154638.9.
International Search Report and Written Opinion dated Jun. 29, 2018, PCT Application No. PCT/EP2018/058174.
International Preliminary Report on Patentability dated Oct. 10, 2019, PCT Application No. PCT/EP2018/058174.
Office Action dated Jan. 24, 2020, U.S. Appl. No. 16/566,711, filed Sep. 10, 2019.
Final Office Action dated Aug. 4, 2020, U.S. Appl. No. 16/566,711, filed Sep. 10, 2019.
Advisory Action dated Oct. 16, 2020, U.S. Appl. No. 16/566,711, filed Sep. 10, 2019.
Notice of Allowance dated Dec. 11, 2020, U.S. Appl. No. 16/566,711, filed Sep. 10, 2019.
European Article 94(3) Examination Report dated Jan. 15, 2020, for European Application No. 18714513.1.
European Article 94(3) Examination Report dated Jul. 29, 2020, for European Application No. 18714513.1.
European Search Report dated Dec. 4, 2019, for European Application No. 19198488.9.
European Article 94(3) Examination Report dated Feb. 3, 2020, , for European Application No. 19198488.9.
Intention to Grant dated Aug. 10, 2020, for European Application No. 19198488.9.
Eurasian Office Action dated Sep. 3, 2020, for Eurasian Application No. 201992243/31.
International Search Report and Written Opinion dated Nov. 28, 2018, PCT Application No. PCT/EP2018/072811.
International Preliminary Report on Patentability dated Mar. 5, 2020, PCT Application No. PCT/EP2018/072811.
International Search Report and Written Opinion dated Feb. 14, 2020, PCT Application No. PCT/EP2019/057149.
Office Action dated Mar. 4, 2020, U.S. Appl. No. 16/710,237, filed Dec. 11, 2019.
Final Office Action dated Sep. 3, 2020, U.S. Appl. No. 16/710,237, filed Dec. 11, 2019.
Office Action dated Feb. 11, 2021, U.S. Appl. No. 16/710,237, filed Dec. 11, 2019.
International Search Report and Written Opinion dated Jun. 4, 2019, PCT Application No. PCT/EP2018/077568.
International Preliminary Report on Patentability dated Apr. 23, 2020, PCT Application No. PCT/EP2018/077568.
International Search Report and Written Opinion dated Jul. 9, 2020, PCT Application No. PCT/EP2018/082985.
International Search Report and Written Opinion dated Jul. 9, 2020, PCT Application No. PCT/EP2019/082808.
Office Action dated Feb. 24, 2020, U.S. Appl. No. 16/698,335, filed Nov. 11, 2019.
Final Office Action dated Jun. 24, 2020, U.S. Appl. No. 16/698,335, filed Nov. 11, 2019.
Advisory Action dated Aug. 25, 2020, U.S. Appl. No. 16/698,335, filed Nov. 11, 2019.
Office Action dated Dec. 3, 2020, U.S. Appl. No. 16/698,335, filed Nov. 11, 2019.
International Search Report and Written Opinion dated Jan. 27, 2020, PCT Application No. PCT/EP2019/056425.
International Search Report and Written Opinion dated Feb. 28, 2020, PCT Application No. PCT/IB2019/055355.
International Search Report and Written Opinion dated Jun. 16, 2020, PCT Application No. PCT/EP2019/075385.
International Search Report and Written Opinion dated Jun. 16, 2020, PCT Application No. PCT/EP2019/075378.
International Search Report and Written Opinion dated Oct. 5, 2017, PCT Application No. PCT/EP2017/058300.
International Preliminary Report on Patentability dated Oct. 18, 2018, PCT Application No. PCT/EP2017/058300.
Intention to Grant dated Dec. 12, 2019, EP Application No. 17715935.7.
Decision to Grant dated May 8, 2020, , EP Application No. 17715935.7.
Office Action dated Dec. 29, 2019, U.S. Appl. No. 16/563,544, filed Sep. 16, 2019.
Notice of Allowance dated Apr. 22, 2020, U.S. Appl. No. 16/563,544, filed Sep. 16, 2019.
European Search Report dated Aug. 10, 2020, EP Application No. 20170700.7.
International Search Report and Written Opinion dated Sep. 22, 2017, PCT Application No. PCT/EP2017/058292.
International Preliminary Report on Patentability dated Oct. 18, 2018, PCT Application No. PCT/EP2017/058292.
International Search Report and Written Opinion dated Jun. 17, 2020, PCT Application No. PCT/US2019/046759.
International Search Report and Written Opinion dated May 12, 2020, PCT Application No. PCT/EP2019/072891.
International Search Report and Written Opinion dated Nov. 6, 2020, PCT Application No. PCT/EP2020/072811.
International Search Report and Written Opinion dated Jul. 9, 2020, PCT Application No. PCT/EP2019/078195.
Office Action dated Jan. 7, 2021, U.S. Appl. No. 17/071,031, filed Oct. 15, 2020.
International Search Report and Written Opinion dated Jun. 16, 2020, PCT Application No. PCT/EP2019/075387.
International Search Report and Written Opinion dated Jun. 16, 2020, PCT Application No. PCT/EP2019/075382.
Partial International Search Report Search Report dated Sep. 10, 2020, PCT Application No. PCT/EP2019/085454.
International Search Report and Written Opinion dated Jul. 9, 2020, PCT Application No. PCT/EP2019/078197.
Office Action dated Jan. 14, 2021, U.S. Appl. No. 17/071,021, filed Oct. 20, 2020.
International Search Report and Written Opinion dated May 29, 2020, PCT Application No. PCT/EP2019/082809.
Office Action dated Mar. 12, 2020, U.S. Appl. No. 16/698,407, filed Nov. 27, 2019.
Final Office Action dated Jun. 30, 2020, U.S. Appl. No. 16/698,407, filed Nov. 27, 2019.
Examination Report dated Jul. 15, 2020, GCC Application No. GC 2019-38726.
International Search Report and Written Opinion dated Jul. 24, 2020, PCT Application No. PCT/EP2019/081545.
International Search Report and Written Opinion dated Feb. 3, 2021, PCT Application No. PCT/EP2020/066171.
Partial International Search Report dated Oct. 20, 2020, PCT Application No. PCT/EP2020/051814.
International Search Report and Written Opinion dated Dec. 11, 2020, PCT Application No. PCT/EP2020/051814.
Partial International Search Report dated Oct. 16, 2020, PCT Application No. PCT/EP2020/051817.
International Search Report and Written Opinion dated Dec. 20, 2020, PCT Application No. PCT/EP2020/051817.

(56) References Cited

OTHER PUBLICATIONS

International Search Report and Written Opinion dated Dec. 9, 2020, PCT Application No. PCT/EP2020/067043.
Abdelgaward, Ahemd, "Distributed Sand Monitoring Framework Using Wireless Sensor Networks," School of Engineering Technology, Central Michigan University, Mount Pleasant, MI 48859, US, Oct. 2013, vol. 1 Is. 1, pp. 1-10.
Bakku, Sudhish K., et al., "Vertical Seismic Profiling Using Distributed Acoustic Sensing in a Hydrofrac Treatment Well," SEG Technical Program Expanded Abstracts Denver 2014 ISSN (print): 1052-3812, ISSN (online): 1949-4645, https://doi.org/10.1190/segam2014-1559.1.
Broesch, James "Digital Signal Processing: Instant Access," Chapter 7, www.newnespress.com.
Brown, Gerald K., "External Acoustic Sensors and Instruments for the Detection of Sand in Oil and Gas Wells," Offshore Technology Conference, May 5-8, 1997, Houston, Texas, US, OTC-8478-MS, https://doi.org/10.4043/8478-MS.
Brown, Gerald K., et al., "Solids and Sand Monitoring—An Overview," Corrosion Mar. 26-31, 2000, Orlando, Florida, US, NACE International, NACE-00091.
Cannon, Robert Thayer, et al., "Distributed Acoustic Sensing: State of the Art," SPE Digital Energy Conference, Mar. 5-7, 2013, The Woodlands, Texas, US, SPE-163688-MS, https://doi.org/10.2118/163688-MS.
Chen, Jianyou, et al., "Distributed acoustic sensing coupling noise removal based on sparse optimization," Society of Exploration Geophysicists and American Association of Petroleum Geologists, vol. 7, Issue 2, May 2019, pp. 1M-T563, ISSN (print): 2324-8858, ISSN (online): 2324-8866, https://doi.org/10.1190/INT-2018-0080.1.
Chhantyal, Khim et al., "Upstream Ultrasonic Level Based Soft Sensing of Volumetric Flow of Non-Newtonian Fluids in Open Venturi Channels," IEEE Sensors Journal, vol. 18, No. 12, Jun. 15, 2018.
ClampOn DSP-06 Particle Monitor, Aug. 2009.
ClampOn SandQ® Monitor, Aug. 2014.
Conway, Chris, et al., "An introduction to fiber optic Intelligent Distributed Acoustic Sensing (iDAS) technology for power industry applications," 9th International Conference on Insulated Power Cables, Jicable15—Versailles Jun. 21-25, 2015, A3.4.
Correa, Julia, et al., "3D vertical seismic profile acquired with distributed acoustic sensing on tubing installation: A case study from the CO2CRC Otway Project," Interpretation—a Journal of Subsurface Characterization, 7(1), ISSN 2324-8858, Feb. 1, 2019, DOI 10.1190/INT-2018-0086.1, https://escholarship.org/uc/item/2br8g398.
Finfer, D.C., et al., "Borehole Flow Monitoring using a Non-intrusive Passive Distributed Acoustic Sensing (DAS)," Society of Petroleum Engineers, SPE-170844-MS, SPE Annual Technical Conference and Exhibition held in Amsterdam, The Netherlands, Oct. 27-29, 2014.
Folkestad, Trond, et al., "Acoustic measurements detect sand in North Sea flow lines," Oil and Gas Journal; (USA), Journal vol. 88:35; Journal ID: ISSN 0030-1388.
Gardner, Neil, et al., "Distributed Fiber-Optic Technologies Drive New Intervention Applications," SPE JPT-7975, vol. 67 | Issue: 1, Jan. 1, 2015.
Hill, David, Permanent real-time full wellbore flow monitoring using distributed fiber-optic sensing, OptaSense, 2015.
Hofman, Joachim, et al., "Analysis of the acoustic response in water and sand of different fiber optic sensing cables," SPIE Sensing Technology + Applications, 2015, Baltimore, Maryland, U.S., Proceedings vol. 9491, Sensors for Extreme Harsh Environments II; 94910E (2015) https://doi.org/10.1117/12.2178282.
Hull, John William, et al., "Well-Integrity Monitoring and Analysis Using Distributed Fiber-Optic Acoustic Sensors," IADC/SPE Drilling Conference and Exhibition, Feb. 2-4, 2010, New Orleans, Louisiana, US, SPE-128304-MS, https://doi.org/10.2118/128304-MS.
Isensys, "Sand Alert—Fixed and Portable Sand Monitoring," Isensys LLP, Sep. 2016, www.isensys.co.uk.
Johannessen, Kjetil, et al., "Distributed Acoustic Sensing—A New Way of Listening to Your Well/Reservoir," SPE Intelligent Energy International, Mar. 27-29, 2012, Utrecht, NL, SPE-149602-MS, https://doi.org/10.2118/149602-MS.
Li, Meng, et al., "Current and Future Applications of Distributed Acoustic Sensing as a New Reservoir Geophysics Tool," The Open Petroleum Engineering Journal, 2015, 8, (Suppl 1: M3) 272-281.
Ma, King, et al. "Deep Learning on Temporal-Spectral Data for Anomaly Detection," Department of Electrical and Computer Engineering, University of Calgary, Proc. of Spie vol. 10190, 2017.
Martin, Shawn, "Can Oil Well Monitoring Systems Withstand Stimulation Treatments," Feb. 26, 2015, https://insights.globalspec.com/article/601/can-oil-well-monitoring-systems-withstand-stimulation-treatments [retrieved on Aug. 18, 2020].
Martinez, Roberto Jr., "Diagnosis of Fracture Flow Conditions With Acoustic Sensing," SPE Hydraulic Fracturing Technology Conference, Feb. 4-6, The Woodlands, Texas, US, Publication Date 2014.
Miller, Douglas E., et al., "Vertical Seismic Profiling Using a Fiber-optic Cable as a Distributed Acoustic Sensor," 74th EAGE Conference Exhibition incorporating SPE EUROPEC 2012, Copenhagen, Denmark, Jun. 4-7, 2012.
Mohd Daud, Farik, et al., "Successful Application of Ultrasound Technology to Detect Sand Producing Intervals in the Wellbore," International Petroleum Technology Conference, Nov. 15-17, 2011, Bangkok, Thailand, IPTC-14737-MS, https://doi.org/10.2523/IPTC-14737-MS.
Molenaar, Mathieu, et al., "Downhole tests show benefits of distributed acoustic sensing," Oil and Gas Journal 109 (1):82-85, Jan. 2011.
Molenaar, Menno M., et al., "First Downhole Application of Distributed Acoustic Sensing for Hydraulic-Fracturing Monitoring and Diagnostics," SPE Drilling Completion, vol. 27, Is. 1, Mar. 2012, SPE-140561-PA, https://doi.org/10.2118/140561-PA.
Mullens, Stephen, et al., "Fiber-Optic Distributed Vibration Sensing Provides Technique for Detecting Sand Production," Offshore Technology Conference, May 3-6, 2010, Houston, Texas, US, OTC-20429-MS, https://doi.org/10.4043/20429-MS.
Naldrett, G., et al., "Production Monitoring Using Next-Generation Distributed Sensing Systems," Petrophysics, vol. 59, No. 4 (Aug. 2018); pp. 496-510; 16 Figures. DOI: 10.30632/PJV59V4-2018a5.
Paleja, Rakesh, et al., "Velocity Tracking for Flow Monitoring and Production Profiling Using Distributed Acoustic Sensing," SPE Annual Technical Conference and Exhibition, Sep. 28-30, 2015, Houston, Texas, US, SPE-174823-MS, https://doi.org/10.2118/174823-MS.
Roxar sand monitor, https://www.emerson.com/en-us/automation/roxar.
Roxar, "Sand Monitor, Non-intrusive acoustic sensor," Draft 1-120209, Sundheim-Madison Feb. 2009.
Schultz, Whitney H., "Time-Lapse Multicomponent Geophone and DAS VSP Processing and Analysis," Colorado School of Mines, Geo-Physics Department, 2019.
Silixa, "Fracture Monitoring," https://silixa.com/solutions/oil-and-gas-downhole/frac-services/fracture-monitoring/.
Silixa, "Well Integrity," https://silixa.com/solutions/oil-and-gas-downhole/permanent-reservoir-and-well-surveillance/well-integrity/.
Silkina, Tatiana, "Application of Distributed Acoustic Sensing to Flow Regime Classification," Natural Gas Technology, Norwegian University of Science and Technology, Jun. 2014.
Stokely, Christopher L., "Acoustics-Based Flow Monitoring During Hydraulic Fracturing," SPE-179151-MS, Society of Petroleum Engineers, SPE Hydraulic Fracturing Technology Conference, Feb. 9-11, 2016, The Woodlands, Texas, USA, https://doi.org/10.2118/179151-MS.
Susilo, Yoliandri, et al., "Significant Increase in Sand Control Reliability of Open Hole Gravel Pack Completions in ACG Field—Azerbaijan," SPE European Formation Damage Conference Exhibition, Jun. 5-7, 2013, Noordwijk, NL, SPE-165206-MS, https://doi.org/10.2118/165206-MS.

(56) References Cited

OTHER PUBLICATIONS

Tiffin, David L., et al., "Drawdown Guidelines for Sand Control Completions", SPE International, SPE 84495, Oct. 5, 2003 (Oct. 5, 2003), pp. 1-10, XP002361435.
Van der Horst, Juun, et al., "Fibre Optic Sensing for Improved Wellbore Production Surveillance," International Petroleum Technology Conference, Jan. 19-22, 2014, Doha, Qatar, IPTC-17528-MS, https://doi.org/10.2523/IPTC-17528-MS.
Wang, Fang, et al., "Pipeline Leak Detection by Using Time-Domain Statistical Features," IEEE Sensors Journal, vol. 17, No. 19, Oct. 2017.
Wang, Kai, et al., "Vibration Sensor Approaches for the Monitoring of Sand Production in Bohai Bay," Hindawi Publishing Corporation, Shock and Vibration, vol. 2015, Article ID 591780, http://dx.doi.org/10.1155/2015/591780.
Williams, J., "Distributed acoustic sensing for pipeline monitoring," Pipeline and Gas Journal Jul. 2012, vol. 239 No. 7.
World first installation of a fibre optic acoustic sensor for reservoir monitoring, Oil and Gas Product News, Oct. 30, 2009.
WorldOil.com, "Adelous unveils distributed acoustic sensor solution for upstream oil gas," May 28, 2015. https://www.worldoil.com/news/2015/5/28/adelos-unveils-distributed-acoustic-sensor-solution-for-upstream-oil-gas.
Xiao, J., et al., "Dynamic Water Injection Profiling in Intelligent Wells Using Distributed Acoustic Sensor with Multimode Optical Fibers," SPE Annual Technical Conference and Exhibition, Sep. 28-30, 2015, Houston, Texas, US, SPE-174865-MS, https://doi.org/10.2118/174865-MS.
Xiao, J.J., et al., "Intelligent Distributed Acoustic Sensing for In-well Monitoring," SPE Saudi Arabia Section Technical Symposium and Exhibition, Apr. 21-24, 2014, Al-Khobar, SA, SPE-172197-MS, https://doi.org/10.2118/172197-MS.

* cited by examiner

SYSTEMS AND METHODS FOR DRAW DOWN IMPROVEMENTS ACROSS WELLBORES

CROSS-REFERENCE TO RELATED APPLICATIONS

This application claims the benefit of and priority to International Application No. PCT/EP2019/081542 filed Nov. 15, 2019 with the European Receiving office and entitled "Systems and Methods for Draw Down Improvements Across Wellbores," which is incorporated herein by reference in its entirety for all purposes.

STATEMENT REGARDING FEDERALLY SPONSORED RESEARCH OR DEVELOPMENT

Not applicable.

BACKGROUND

To obtain hydrocarbons from subterranean formations, wellbores are drilled from the surface to access the hydrocarbon-bearing formation. After drilling a wellbore to the desired depth, a production string is installed in the wellbore to produce the hydrocarbons from one or more production zones of the formation to the surface. In some wellbores, fine particulate matter (which is generally referred to herein as "sand") may be produced along with other fluids (e.g., hydrocarbon liquids, gas, water, etc.). These fluids can create certain issues including damaging the production tubing or surface equipment while also requiring additional equipment to process at the surface. Thus, it is desirable to prevent certain fluids from advancing into the wellbore, or to reduce or minimize (or prevent entirely) the production of such fluids from the subterranean formation.

BRIEF SUMMARY

In some embodiments, a method for determining an operating envelope for a wellbore can include receiving an indication of a hydrocarbon production rate of a hydrocarbon fluid into the wellbore from at least one production zone, receiving an indication of a fluid production rate of a fluid into the wellbore from the at least one production zone, receiving an indication of a pressure within the wellbore while producing the one or more fluids from the wellbore from the at least one production zone, correlating the indication of the pressure with the hydrocarbon production rate and the fluid production rate, and determining an operating envelope based on the correlating. The fluid production rate comprises at least one of: an aqueous fluid production rate or a gas production rate. The operating envelope defines a boundary for the indication of the pressure, the fluid production rate, and the hydrocarbon production rate.

In some embodiments, a system for determining an operating envelope for a wellbore comprises: a monitoring assembly configured to detect one or more values related to the wellbore, and a processor. The processor is configured to execute an analysis program to: receive, from the monitoring assembly, a sensor signal, wherein the sensor signal is generated while producing one or more fluids from at least one production zone within the wellbore, receive an indication of a hydrocarbon production rate of a hydrocarbon fluid from the at least one production zone using the sensor signal, receive an indication of indication of a fluid production rate of a fluid using the sensor signal, receive an indication of a pressure within the wellbore, correlate the indication of the pressure with the hydrocarbon production rate and the fluid production rate, and determine an operating envelope based on the correlation. The operating envelope defines a boundary for the indication of the pressure, the fluid production rate, and the hydrocarbon production rate.

In some embodiments, a method of controlling a drawdown pressure in a wellbore comprises: producing one or more hydrocarbon fluid from a wellbore at a first production rate, increasing a production of the hydrocarbon fluid from the first production rate to a second production rate, and limiting the fluid production rate of the fluid into the wellbore during the pressure increase based on maintaining the pressure within the operating envelope. The first production rate is less than the second production rate, and the production rate increase is maintained within an operating envelope. The operating envelope defines a boundary between a pressure within the wellbore, a hydrocarbon production rate of the hydrocarbon fluid, and a fluid production rate of a fluid from a production zone in the wellbore.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
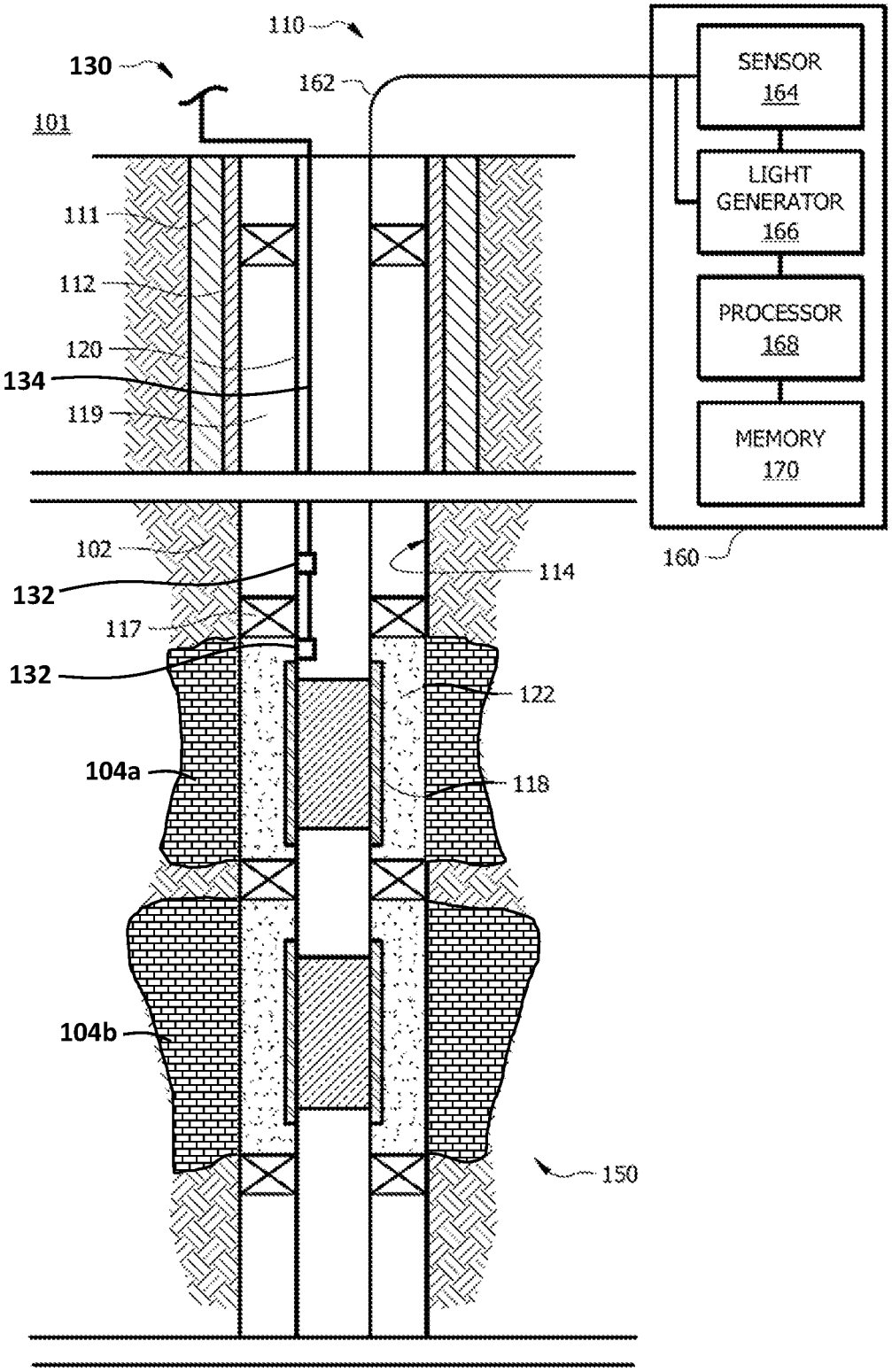
FIG. 1 is a schematic, cross-sectional illustration of a downhole wellbore environment according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal" or "longitudinally" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

As utilized herein, a 'fluid inflow event' includes fluid inflow (e.g., any fluid inflow regardless of composition thereof), gas phase inflow, aqueous phase inflow, and/or hydrocarbon phase inflow. The fluid can comprise other components such as solid particulate matter in some embodiments, as discussed in more detail herein.

During the production of hydrocarbons from subterranean formations, various undesirable fluids can also be produced. For example, an aqueous fluid such as a brine can be produced along with liquid hydrocarbons (e.g., crude oil, condensates, etc.). The fluids can result from connate fluids in the reservoir, injected fluids (e.g., fluids injected for enhanced oil recovery, etc.) or the like. When produced, the fluids have to be separated from the desired hydrocarbons and processed, either to be disposed on the surface or reinjected into the reservoir for disposal. The equipment to handle the separations and processing of the fluids can be expensive and affect the economics of obtaining the desired hydrocarbon fluids.

When a zone within a wellbore begins to produce undesirable fluids with the hydrocarbon fluids, the common response is to close off the zone to production. This may still allow other zones to continue to produce hydrocarbons until fluids are also produced from those zones. For example, when an aqueous fluid is produced with an oil stream, the producing zone may be shut off once the percentage of the aqueous fluid rises above a threshold (e.g., when the "water cut" rises above a predefined value). Shutting in the producing zone then sacrifices the hydrocarbons that could otherwise be produced from the zone in the wellbore.

It is generally anticipated that the ratio of a fluid phase to a desired hydrocarbon phase will either remain steady or rise based on an increased production from a zone in which the fluid is being produced along with the hydrocarbon phase. For example, an aqueous fluid or a gas phase can have an increased production relative to a desired hydrocarbon phase as a drawdown pressure is increased. This understanding makes it unlikely that a zone would be allowed to continue to produce a hydrocarbon fluid on the basis that the undesirable fluids would continue to be produced in the same proportions or even be produced in a greater proportion, which would require additional equipment to handle such fluid production.

As disclosed herein, a process and system is described that allows for a relationship between a production rate of a hydrocarbon phase, a production rate of a fluid phase (e.g., an undesirable fluid phase), and an operating parameter such as pressure, rate of change, or pressure, force on the formation, or the like to be developed. The resulting relationship can be referred to as an operating envelope. The operating envelope can define limits for the operating parameter with respect to limiting an amount of the fluid or a ratio of the fluid production rate to the hydrocarbon production rate.

As described in more detail herein, the operating envelope can be developed by monitoring a wellbore and obtaining a dynamic measurement of the fluid production rates of both a hydrocarbon fluid and a secondary fluid. The dynamic measurements can occur over time. The operating parameter can also be measured during the dynamic measurements of the hydrocarbon production rate and the fluid production rate. The resulting measurements can then be correlated to form the operating envelope, which in some embodiments, can be a mathematical relationship between the variables.

It is has been found that in some instances, the resulting relationship can show that the fluid production rate does not increase linearly with the hydrocarbon production rate as a function of the operating parameter. Rather, a non-linear relationship can exist between the variables that can allow for the operating parameter to be selected such that the ratio of the fluid production rate to the hydrocarbon production rate can be reduced or minimized. This can allow the hydrocarbon to continue to be produced from a zone in a wellbore with a reduced production rate of the fluid, thereby allowing the hydrocarbon to be recovered economically.

In some embodiments, the operating parameter can be a pressure, a rate of pressure changes, or a force on the production face. As used herein, the term "drawdown pressure" refers to the pressure differential between the pressure of a subterranean formation and the pressure of a wellbore extending through the formation (this is sometimes also referred to as the "pressure drawdown"). To allow production fluids to enter the wellbore for production to the surface, the drawdown pressure is set such that the pressure within the wellbore is generally less than the pressure of the formation. Thus, the drawdown pressure drives formation fluids from the subterranean formation into the wellbore during production operations, and one would normally expect the drawdown pressure to be proportional (or at least related to) to the flow rate of production fluids into the wellbore. Accordingly, as the drawdown pressure increases (i.e., the pressure differential between the formation and wellbore increases) the flow rate of formation fluids into the wellbore from the formation should also increase. As described herein, the drawdown pressure may be influenced or managed by the actuation of choke valves or other pressure adjustment devices (e.g., pumps, valves, etc.), and can be selected individually across zones when the proper completion assemblies are present.

In some circumstances, a rate of fluid produced along with a hydrocarbon fluid may be influenced by adjusting the drawdown pressure within the wellbore during operations. For instance, one might lower a drawdown pressure so as to limit or at least reduce the fluid production rate into a given wellbore. In addition, the rate of change for the pressure drawdown may also affect a rate of fluid production during operations. Specifically, if a drawdown pressure is changed relatively rapidly (e.g., increased), then a force on the production face of one or more production zones within the wellbore may increase such that fluid is more readily mobilized within the formation and can flow into the wellbore along with other production fluids (e.g., oil, gas, water, etc.). In some embodiments, the relative amount of the fluid production from the wellbore can be influenced by the force on the production face of a wellbore, which may be measured or characterized by one or more of a flux of the one or more fluids through the production face of the wellbore or an acceleration of the one or more fluids between a reservoir and an interior of the wellbore at the production face of the wellbore. Thus, as used herein, the "force on the production face" of a production zone of a wellbore may refer to any of these above-listed parameters. In addition, as will be described in more detail below some or all of these parameters characterizing the force on the production face may be influenced or may directly result from the drawdown pressure (and specifically changes in the drawdown pressure) during production operations. Accordingly, in at least some of the embodiments described herein, the force on the production face of a production zone of a wellbore may be assessed and monitored via one or more pressure measurements (e.g., a wellbore pressure, drawdown pressure, formation pressure, etc.).

Thus, control of the operating parameters such as the absolute pressure, the drawdown pressure, the rate of pressure change, or the force on the production face can be managed via a choke or other suitable pressure adjustment devices as previously described above, and may be called for to reduce or minimize a rate of fluid production into a subterranean wellbore along with a hydrocarbon fluid. Embodiments disclosed herein include systems and methods for detecting and/or characterizing fluid inflow and production rates within a subterranean wellbore along the monitoring of operating parameters, so that a wellbore operator may more effectively reduce or minimize undesirable fluid production into the wellbore along with hydrocarbon production during operations. In some embodiments, utilizing the systems and methods described herein, the operating envelope may be developed to define operating parameters of the wellbore (e.g., a rate of pressure change in the production zone, a flux of the one or more fluids through the production face of the wellbore, or an acceleration of the one or more fluids between a reservoir and an interior of the wellbore at the production face of the wellbore, etc.) so as to limit fluid production during operations. In some embodiments, a distributed acoustic sensor (DAS) may be utilized to detect the fluid production and/or hydrocarbon production within a wellbore. In some embodiments, the determined operating envelope may be applied to one or more production zones in the same or other wellbores that have corresponding geophysical properties. In some embodiments, the operating envelopes developed in certain wellbores can be used across or between reservoirs to enable production control (e.g., production rate control with an appropriate fluid production control, etc.) for wellbores that have not previously been monitored.

Referring now to FIG. 1, where a schematic, cross-sectional illustration of a downhole wellbore operating environment 101 according to some embodiments is shown. More specifically, environment 101 includes a wellbore 114 traversing a subterranean formation 102, casing 112 lining at least a portion of wellbore 114, and a tubular 120 extending through wellbore 114 and casing 112. A plurality of completion assemblies such as spaced screen elements or assemblies 118 may be provided along tubular 120 at one or more production zones 104*a*, 104*b* within the subterranean formation 102. In particular, two production zones 104*a*, 104*b* are depicted within subterranean formation 102 of FIG. 1; however, the precise number and spacing of the production zones 104*a*, 104*b* may be varied in different embodiments. The production zones 104*a*, 104*b* may be layers, zones, or strata of formation 102 that contain hydrocarbon fluids (e.g., oil, gas, condensate, etc.) therein.

In addition, a plurality of spaced zonal isolation devices 117 and gravel packs 122 may be provided between tubular 120 and the sidewall of wellbore 114 at or along the interface of the wellbore 114 with the production zones 104*a*, 104*b*. In some embodiments, the operating environment 101 includes a workover and/or drilling rig positioned at the surface and extending over the wellbore 114. While FIG. 1 shows an example completion configuration in FIG. 1, it should be appreciated that other configurations and equipment may be present in place of or in addition to the illustrated configurations and equipment.

In general, the wellbore 114 can be formed in the subterranean formation 102 using any suitable technique (e.g., drilling). The wellbore 114 can extend substantially vertically from the earth's surface over a vertical wellbore portion, deviate from vertical relative to the earth's surface over a deviated wellbore portion, and/or transition to a horizontal wellbore portion. In general, all or portions of a wellbore may be vertical, deviated at any suitable angle, horizontal, and/or curved. In addition, the wellbore 114 can be a new wellbore, an existing wellbore, a straight wellbore, an extended reach wellbore, a sidetracked wellbore, a multilateral wellbore, and other types of wellbores for drilling and completing one or more production zones. As illustrated, the wellbore 114 includes a substantially vertical producing section 150 which includes the production zones 104*a*, 104*b*. In this embodiment, producing section 150 is an open-hole completion (i.e., casing 112 does not extend through producing section 150). Although section 150 is illustrated as a vertical and open-hole portion of wellbore 114 in FIG. 1, embodiments disclosed herein can be employed in sections of wellbores having any orientation, and in open or cased sections of wellbores. The casing 112 extends into the wellbore 114 from the surface and can be secured within the wellbore 114 with cement 111.

The tubular 120 may comprise any suitable downhole tubular or tubular string (e.g., drill string, casing, liner, jointed tubing, and/or coiled tubing, etc.), and may be inserted within wellbore 114 for any suitable operation(s) (e.g., drilling, completion, intervention, workover, treatment, production, etc.). In the embodiment shown in FIG. 2, the tubular 120 is a completion assembly string. In addition, the tubular 120 may be disposed within any or all portions of the wellbore 114 (e.g., vertical, deviated, horizontal, and/or curved section of wellbore 114).

In this embodiment, the tubular 120 extends from the surface to the production zones 104*a*, 104*b* and generally provides a conduit for fluids to travel from the formation 102 (particularly from production zones 104*a*, 104*b*) to the surface. A completion assembly including the tubular 120 can include a variety of other equipment or downhole tools to facilitate the production of the formation fluids from the production zones. For example, zonal isolation devices 117 can be used to isolate the production zones 104*a*, 104*b* within the wellbore 114. In this embodiment, each zonal isolation device 117 comprises a packer (e.g., production packer, gravel pack packer, frac-pac packer, etc.). The zonal isolation devices 117 can be positioned between the screen assemblies 118, for example, to isolate different gravel pack zones or intervals along the wellbore 114 from each other. In general, the space between each pair of adjacent zonal isolation devices 117 defines a production interval, and each production interval may corresponding with one of the production zones 104*a*, 104*b* of subterranean formation 102.

The screen assemblies 118 provide sand control capability. In particular, the sand control screen elements 118, or other filter media associated with wellbore tubular 120, can be designed to allow fluids to flow therethrough but restrict and/or prevent particulate matter of sufficient size from flowing therethrough. The screen assemblies 118 can be of the type known as "wire-wrapped", which are made up of a wire closely wrapped helically about a wellbore tubular, with a spacing between the wire wraps being chosen to allow fluid flow through the filter media while keeping particulates that are greater than a selected size from passing between the wire wraps. Other types of filter media can also be provided along the tubular 120 and can include any type of structures commonly used in gravel pack well completions, which permit the flow of fluids through the filter or screen while restricting and/or blocking the flow of particulates (e.g. other commercially-available screens, slotted or perforated liners or pipes; sintered-metal screens; sintered-sized, mesh screens; screened pipes; prepacked screens and/or liners; or combinations thereof). A protective outer shroud having a plurality of perforations therethrough may be positioned around the exterior of any such filter medium.

The gravel packs 122 are formed in the annulus 119 between the screen elements 118 (or tubular 120) and the sidewall of the wellbore 114 in an open hole completion. In general, the gravel packs 122 comprise relatively coarse granular material placed in the annulus to form a rough screen against the ingress of sand into the wellbore while also supporting the wellbore wall. The gravel pack 122 is optional and may not be present in all completions.

In some embodiments, one or more of the completion assemblies can comprise flow control elements such as sliding sleeves, chokes, valves, or other types of flow control devices that can control the flow of a fluid from an individual production zone or a group of production zones. The operating parameters for the zone can then vary based on the type of completion within the wellbore and/or each production zone (e.g., in a sliding sleeve completion, open hole completion, gravel pack completion, etc.). In some embodiments, a sliding sleeve or other flow controlled production zone can have an operating parameter such as a drawdown pressure that is relatively uniform within the production zone, or the operating parameter can be different between each production zone. For example, a first production zone can have a specific flow control setting that allows the pressure and rate of change of pressure within the first zone to be different than a second production zone. Thus, the choice of completion type (e.g., which can be specified in a completion plan) can depend on the need for or the ability to provide a different force on the production face within different production zones. This can allow for improved production using the processes described herein at one or more production zones within the wellbore.

In some embodiments, a pressure monitoring system 130 may be installed (e.g., partially installed) within wellbore 114. Pressure monitoring system 130 may include one (or a plurality of) pressure sensors 132 disposed in various locations within wellbore 114 and configured to measure or detect a pressure therein. For instance, in some embodiments, pressure monitoring systems 130 may comprise a plurality of distributed pressure sensors within the wellbore 114 (e.g., sensors similar to pressure sensor 132). In some embodiments, the pressure sensors may comprise a fiber optic based distributed pressure sensor or sensors capable of determining the pressure within one or more locations (e.g., one or more production zones, etc.) within the wellbore. In some embodiments, a pressure sensor of the pressure monitoring system 130 (e.g., pressure sensor 132) may be configured to measure or detect one or more of a pressure of the formation (e.g., such as a pressure of the production zones 104*a*, 104*b*, etc.), a pressure of production tubing (e.g., production tubing 120), or a pressure within the gravel pack 122, etc. Thus, the pressure measured within the wellbore can be above the production zones, within one production zones, within a plurality of production zones, or any other location within the wellbore. The pressure can then provide an indication of the pressure within the wellbore, and in some embodiments, will generally provide an indication of the drawdown pressure by measuring a pressure between a pressure control device and the producing zone. As will be described in more detail below, in some embodiments, pressure monitoring system 130 may be used to determine the operating parameter within the wellbore such as a drawdown pressure. In addition, the pressure measurements from the pressure monitoring system 130 may be used to determine, infer, estimate, etc. one or more of the above described parameters that characterize a rate of pressure change and/or force on the production face of a production zone (e.g., production zones 104*a*, 104*b*) of the wellbore 114.

A fluid monitoring system can also be present in the wellbore. The fluid monitoring system can serve to monitor the inflow and/or flow of fluids along the wellbore. In some embodiments, a DAS system 110 can be disposed in the wellbore. As described herein, a DAS system 110 may be utilized to detect or monitor fluid inflow and/or flow along the wellbore 114. In some embodiments, the DAS system 110 can be used to characterize the phase of an inflowing fluid and/or specific volumetric measurements of the fluids to obtain production rates of the hydrocarbon and one or more additional fluids. While described with respect to a DAS system, other monitoring systems (e.g., acoustic monitoring systems whether or not based on fiber optic sensors) including any point or distributed downhole monitoring systems can also be used within the wellbore, as described in more detail herein. The various monitoring systems (e.g., acoustic monitoring systems) may be referred to herein as a "fluid detection system," and/or a "fluid monitoring system." In some embodiments, the DAS system 110 can also serve to monitor other components of a fluid such as solid particles (e.g., sand) within one or more inflowing fluids.

Figure 2A:
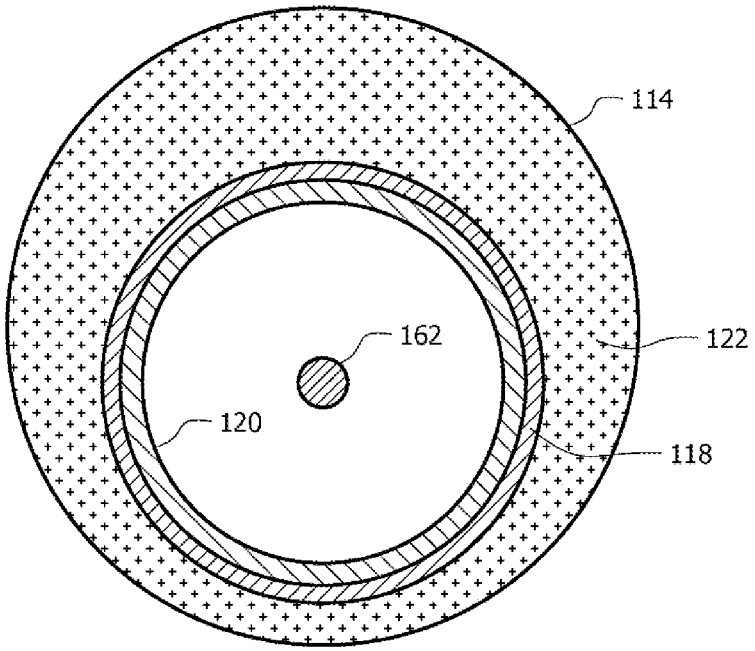
FIGS. 2A and 2B are a schematic, cross-sectional views of embodiments of a well with a wellbore tubular having an optical fiber inserted therein according to some embodiments.
Figure 2B:
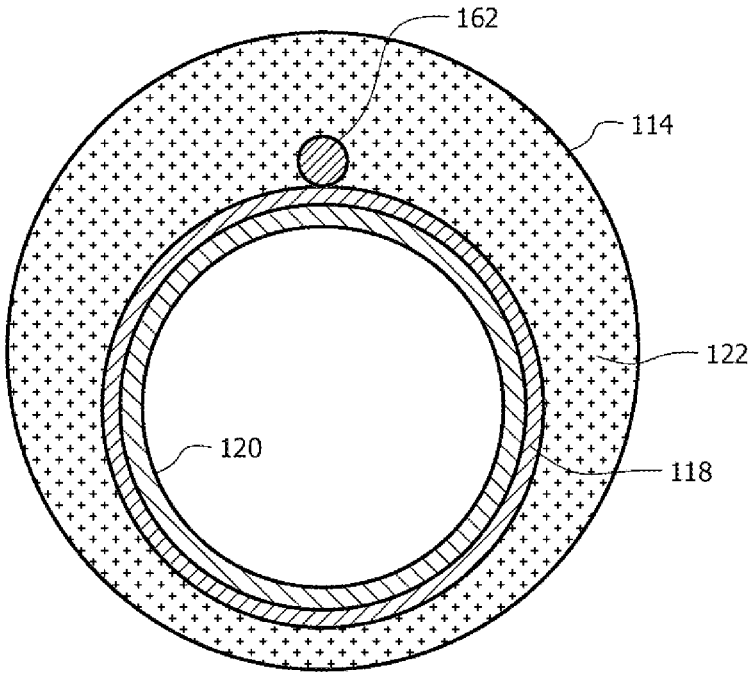

The DAS system 110 comprises an optical fiber 162 that is coupled to and extends along tubular 120. In cased completions, the optical fiber 162 can be installed between the casing and the wellbore wall within a cement layer and/or installed within the casing or production tubing. Referring briefly to FIGS. 2A and 2B, optical fiber 162 of DAS system 110 may be coupled to an exterior of tubular 120 (e.g., such as shown in FIG. 2B) or an interior of tubular (e.g., such as shown in FIG. 2A). When the optical fiber 162 is coupled to the exterior of the tubular 120, as depicted in the embodiment of FIG. 2B, the optical fiber 162 can be positioned within a control line, control channel, or recess in the tubular 120. In some embodiments an outer shroud contains the tubular 120 and protects the optical fiber 162 during installation. A control line or channel can be formed in the shroud and the optical fiber 162 can be placed in the control line or channel (not specifically shown in FIGS. 2A and 2B).

Referring again to FIG. 1, generally speaking, during operations an optical backscatter component of light injected into the optical fiber 162 may be used to detect acoustic perturbations (e.g., dynamic strain) along the length of the fiber 162. The light can be generated by a light generator or source 166 such as a laser, which can generate light pulses. The light used in the system is not limited to the visible spectrum, and light of any frequency can be used with the systems described herein. Accordingly, the optical fiber 162 acts as the sensor element with no additional transducers in the optical path, and measurements can be taken along the length of the entire optical fiber 162. The measurements can then be detected by an optical receiver such as sensor 164 and selectively filtered to obtain measurements from a given depth point or range, thereby providing for a distributed measurement that has selective data for a plurality of zones (e.g., production zones 104*a*, 104*b*) along the optical fiber 162 at any given time. For example, time of flight measurements of the backscattered light can be used to identify individual zones or measurement lengths of the fiber optic 162. In this manner, the optical fiber 162 effectively functions as a distributed array of microphones spread over the entire length of the optical fiber 162, which typically across production zones 104*a*, 104*b* within the wellbore 114, to detect downhole acoustic signals.

The light backscattered up the optical fiber 162 as a result of the optical backscatter can travel back to the source, where the signal can be collected by a sensor 164 and processed (e.g., using a processor 168). In general, the time the light takes to return to the collection point is proportional to the distance traveled along the optical fiber 162, thereby allowing time of flight measurements of distance along the optical fiber. The resulting backscattered light arising along the length of the optical fiber 162 can be used to characterize the environment around the optical fiber 162. The use of a controlled light source 166 (e.g., having a controlled spectral width and frequency) may allow the backscatter to be collected and any disturbances along the length of the optical fiber 162 to be analyzed. In general, any acoustic or dynamic strain disturbances along the length of the optical fiber 162 can result in a change in the properties of the backscattered light, allowing for a distributed measurement of both the acoustic magnitude (e.g., amplitude), frequency and, in some cases, of the relative phase of the disturbance. Any suitable detection methods including the use of highly coherent light beams, compensating interferometers, local oscillators, and the like can be used to produce one or more signals that can be processed to determine the acoustic signals or strain impacting the optical fiber along its length.

An acquisition device 160 may be coupled to one end of the optical fiber 162 that comprises the sensor 164, light generator 166, a processor 168, and a memory 170. As discussed herein, the light source 166 can generate the light (e.g., one or more light pulses), and the sensor 164 can collect and analyze the backscattered light returning up the optical fiber 162. In some contexts, the acquisition device 160 (which comprises the light source 166 and the sensor 164 as noted above), can be referred to as an interrogator. The processor 168 may be in signal communication with the sensor 164 and may perform various analysis steps described in more detail herein. While shown as being within the acquisition device 160, the processor 168 can also be located outside of the acquisition device 160 including being located remotely from the acquisition device 160. The sensor 164 can be used to obtain data at various rates and may obtain data at a sufficient rate to detect the acoustic signals of interest with sufficient bandwidth. While described as a sensor 164 in a singular sense, the sensor 164 can comprise one or more photodetectors or other sensors that can allow one or more light beams and/or backscattered light to be detected for further processing. In an embodiment, depth resolution ranges in a range of from about 1 meter to about 10 meters, or less than or equal to about 10, 9, 8, 7, 6, 5, 4, 3, 2, or 1 meter can be achieved. Depending on the resolution needed, larger averages or ranges can be used for computing purposes. When a high depth resolution is not needed, a system may have a wider resolution (e.g., which may be less expensive) can also be used in some embodiments. Data acquired by the DAS system 110 (e.g., via fiber 162, sensor 164, etc.) may be stored on memory 170.

While the system 101 described herein can be used with a DAS system (e.g., DAS system 110) to acquire an acoustic signal for a location or depth range in the wellbore 114, in general, any suitable acoustic signal acquisition system can be used in performing embodiments of method 10 (see e.g., FIG. 1). For example, various microphones, geophones, hydrophones, or other sensors can be used to provide an acoustic signal at a given location based on the acoustic signal processing described herein. Further, an optical fiber comprising a plurality of point sensors such as Bragg gratings can also be used. As described herein, a benefit of the use of the DAS system 110 is that an acoustic signal can be obtained across a plurality of locations and/or across a continuous length of the wellbore 114 rather than at discrete locations.

During operations, the fluid flowing into the tubular 120 may comprise hydrocarbon fluids, such as, for instance hydrocarbon liquids (e.g., oil) or gases (e.g., natural gas such as methane, ethane, etc.). However, the fluid flowing into the tubular may also comprise other fluids, such as, for instance an aqueous liquid (e.g., water, brine, etc.), steam, carbon dioxide, and/or various multiphase mixed flows. While hydrocarbon gases can be the desired production component from the wellbore, in some instances, a hydrocarbon gas phase can be considered the undesirable fluid, alone or in addition to an aqueous phase fluid. For example, a liquid hydrocarbon phase can be desired and a hydrocarbon gas phase can be produced along with the liquid hydrocarbon phase. In addition, as previously mentioned above, in some embodiments, the fluid flowing into the tubular 120 may also include sand. The fluid flow can further be time varying such as including slugging, bubbling, or time altering flow rates of different phases. The amounts or flow rates of these components can vary over time based on conditions within the formation 102 and the wellbore 114. Likewise, the composition of the fluid flowing into the tubular 120 sections throughout the length of the entire production string (e.g., including the amount of sand contained within the fluid flow) can vary significantly from section to section at any given time.

One or more fluids can be produced into the wellbore 114 and into the completion assembly string. As the fluids enter the wellbore 114, the fluids may create acoustic sounds that can be detected using an acoustic sensor such as a DAS system (e.g., fiber 162). Accordingly, the flow of the various fluids into the wellbore 114 and/or through the wellbore 114 can create vibrations or acoustic sounds that can be detected using the DAS system 110. Each type of event such as the different fluid flows and fluid flow locations can produce an acoustic signature with unique frequency domain features.

As used herein, various frequency domain features can be obtained from the acoustic signal, and in some contexts, the frequency domain features can also be referred to herein as spectral features or spectral descriptors. The frequency domain features are features obtained from the frequency domain analysis of the acoustic signals obtained within the wellbore. The frequency domain features can be derived from the full spectrum of the frequency domain of the acoustic signal such that each of the frequency domain features can be representative of the frequency spectrum of the acoustic signal. Further, a plurality of different frequency domain features can be obtained from the same acoustic signal, where each of the different frequency domain features is representative of frequencies across the same frequency spectrum of the acoustic signal as the other frequency domain features. For example, the frequency domain features (e.g., each frequency domain feature) can be statistical shape measurement or spectral shape function of the spectral power measurement across the same frequency bandwidth of the acoustic signal. Further, as used herein, frequency domain features can also refer to features or feature sets derived from one or more frequency domain features, including combinations of features, mathematical modifications to the one or more frequency domain features, rates of change of the one or more frequency domain features, and the like.

Specific spectral signatures can be determined for each event by considering one or more frequency domain features of the acoustic signal obtained from the wellbore. More specifically, each event can have a characteristic set of frequency domain features, or combinations thereof (e.g., an acoustic or spectral signature), that fall within certain thresholds as defining the event. The resulting spectral signatures can then be used along with processed acoustic signal data to detect and/or characterize an event at a depth range of interest by matching the detected frequency domain features to the acoustic signature(s). The events can include various fluid and/or particulate flows (e.g., sand) and/or inflows as described herein. The spectral signatures can be determined by considering the different types of flow occurring within a wellbore and characterizing the frequency domain features for each type of flow. In some embodiments, various combinations and/or transformations of the frequency domain features can be used to characterize each type of flow. Further, in some embodiments, the frequency domain features may further be used to classify a flow rate of each identified type of flow.

In some embodiments, combinations of frequency domain features can be used. This can include use of the frequency domain features with one or more event signatures having multiple frequency domain features as indicators. In some embodiments, a plurality of frequency domain features can be transformed to create values that can be used to define various event signatures. This can include mathematical transformations including ratios, equations, rates of change, transforms (e.g., wavelets, Fourier transforms, other wave form transforms, etc.), other features derived from the feature set, and/or the like as well as the use of various equations that can define lines, surfaces, volumes, or multivariable envelopes. The transformation can use other measurements or values outside of the frequency domain features as part of the transformation.

Various frequency domain features can be used including, but not limited to, the spectral centroid, the spectral spread, the spectral roll-off, the spectral skewness, the root mean square (RMS) band energy (or the normalized sub-band energies/band energy ratios), a loudness or total RMS energy, a spectral flatness, a spectral slope, a spectral kurtosis, a spectral flux, a spectral autocorrelation function, or any normalized variant thereof.

The spectral centroid denotes the "brightness" of the sound captured by the optical fiber (e.g., optical fiber 162 shown in FIG. 1) and indicates the center of gravity of the frequency spectrum in the acoustic sample. The spectral centroid can be calculated as the weighted mean of the frequencies present in the signal, where the magnitudes of the frequencies present can be used as their weights in some embodiments.

The spectral spread is a measure of the shape of the spectrum and helps measure how the spectrum is distributed around the spectral centroid. In order to compute the spectral spread, Si, one has to take the deviation of the spectrum from the computed centroid as per the following equation (all other terms defined above):

$$S_i = \sqrt{\frac{\sum_{k=1}^{N} (f(k) - C_i)^2 X_i(k)}{\sum_{k=1}^{N} X_i(k)}}. \quad \text{(Eq. 1)}$$

The spectral roll-off is a measure of the bandwidth of the audio signal. The Spectral roll-off of the $i^{th}$ frame, is defined as the frequency bin 'y' below which the accumulated magnitudes of the short-time Fourier transform reach a certain percentage value (usually between 85%-95%) of the overall sum of magnitudes of the spectrum.

$$\sum_{k=1}^{y} |X_i(k)| = \frac{c}{100} \sum_{k=1}^{N} |X_i(k)|, \quad \text{(Eq. 2)}$$

where c=85 or 95. The result of the spectral roll-off calculation is a bin index and enables distinguishing acoustic events based on dominant energy contributions in the frequency domain (e.g., between gas influx and liquid flow, etc.).

The spectral skewness measures the symmetry of the distribution of the spectral magnitude values around their arithmetic mean.

The RMS band energy provides a measure of the signal energy within defined frequency bins that may then be used for signal amplitude population. The selection of the bandwidths can be based on the characteristics of the captured acoustic signal. In some embodiments, a sub-band energy ratio representing the ratio of the upper frequency in the selected band to the lower frequency in the selected band can range between about 1.5:1 to about 3:1. In some embodiments, the sub-band energy ratio can range from about 2.5:1 to about 1.8:1, or alternatively be about 2:1. The total RMS energy of the acoustic waveform calculated in the time domain can indicate the loudness of the acoustic signal. In some embodiments, the total RMS energy can also be extracted from the temporal domain after filtering the signal for noise.

The spectral flatness is a measure of the noisiness/tonality of an acoustic spectrum. It can be computed by the ratio of the geometric mean to the arithmetic mean of the energy spectrum value and may be used as an alternative approach to detect broad-banded signals. For tonal signals, the spectral flatness can be close to 0 and for broader band signals it can be closer to 1.

The spectral slope provides a basic approximation of the spectrum shape by a linearly regressed line. The spectral slope represents the decrease of the spectral amplitudes from low to high frequencies (e.g., a spectral tilt). The slope, the y-intersection, and the max and media regression error may be used as features.

The spectral kurtosis provides a measure of the flatness of a distribution around the mean value.

The spectral flux is a measure of instantaneous changes in the magnitude of a spectrum. It provides a measure of the frame-to-frame squared difference of the spectral magnitude vector summed across all frequencies or a selected portion of the spectrum. Signals with slowly varying (or nearly constant) spectral properties (e.g., noise) have a low spectral flux, while signals with abrupt spectral changes have a high spectral flux. The spectral flux can allow for a direct measure of the local spectral rate of change and consequently serves as an event detection scheme that could be used to pick up the onset of acoustic events that may then be further analyzed using the feature set above to identify and uniquely classify the acoustic signal.

The spectral autocorrelation function provides a method in which the signal is shifted, and for each signal shift (lag) the correlation or the resemblance of the shifted signal with the original one is computed. This enables computation of the fundamental period by choosing the lag, for which the signal best resembles itself, for example, where the autocorrelation is maximized. This can be useful in exploratory signature analysis/even for anomaly detection for well integrity monitoring across specific depths where well barrier elements to be monitored are positioned.

Any of these frequency domain features, or any combination of these frequency domain features (including transformations of any of the frequency domain features and combinations thereof), can be used to detect fluid inflow within the wellbore as well as to potentially determine the location, type, and flow rate of fluid inflow or fluid flow as described herein. In an embodiment, a selected set of characteristics can be used to identify the presence or absence for each event, and/or all of the frequency domain features that are calculated can be used as a group in characterizing the presence or absence of an event. The specific values for the frequency domain features that are calculated can vary depending on the specific attributes of the acoustic signal acquisition system, such that the absolute value of each frequency domain feature can change between systems. In some embodiments, the frequency domain features can be calculated for each event based on the system being used to capture the acoustic signal and/or the differences between systems can be taken into account in determining the frequency domain feature values for each fluid inflow event between or among the systems used to determine the values and the systems used to capture the acoustic signal being evaluated.

Referring again to FIG. 1, the processor 168 within the acquisition device 160 may be configured to perform various data processing processes to detect the fluid inflow events of one or more fluids along the length of the wellbore 114 (more specifically along the length of optical fiber 162). For instance, the memory 170 may be configured to store an application or program (e.g., comprising machine-readable instructions, such as, for instance, non-transitory machine-readable instructions) to perform the data analysis. While shown as being contained within the acquisition device 160, the memory 170 can comprise one or more memories, any of which can be external to the acquisition device 160. In some embodiments, the processor 168 can execute the application, which can configure the processor 168 to filter the acoustic data set spatially, and determine one or more frequency domain features of the acoustic signal. In addition, in some embodiments the processor 168 (as a result of executing the application) may further determine the fluid production rate, the hydrocarbon production rate, and/or one or more additional fluid production rates at the selected location based on the analysis described hereinbelow. The analysis can be repeated across various locations along the length of the wellbore 114 to determine the locations of fluid inflows, the makeup of a fluid (e.g., gas, water, hydrocarbon liquid, individual fluid phases, etc.), and the flow rate or amount of some or all of the fluid along the length of the wellbore 114.

Figure 3:
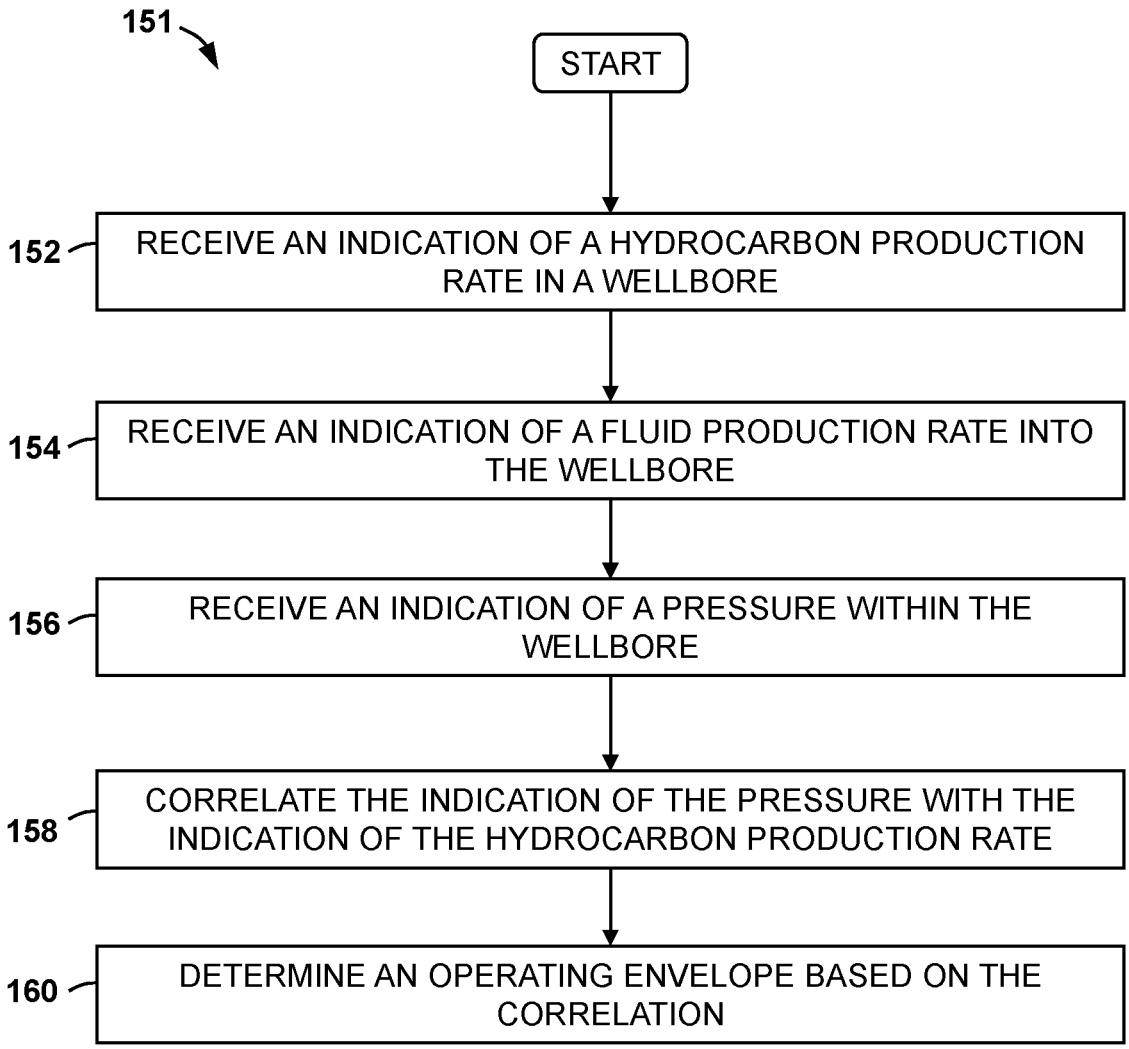
FIG. 3 a flow diagram of a method for determining an operating envelope for improving the draw down in a wellbore according to some embodiments.

Referring now to FIG. 3, a flow chart of a method 151 for determining an operating envelope for improving the draw down in a wellbore is shown. The method can begin with receiving an indication of a hydrocarbon production rate of a hydrocarbon fluid into the wellbore at step 152. The hydrocarbon fluid can be the fluid of interest that is being produced from at least one production zone in the wellbore. In general, one or more fluids can also be produced from the wellbore in addition to the hydrocarbon fluid. In some embodiments, the indication of the hydrocarbon production rate can be a signal from a sensor within the wellbore. For example, the indication can be an acoustic signal from the at least one production zone that can be used to identify and quantify the production rate of the hydrocarbon fluid into the wellbore.

At step 154, an indication of a fluid production rate can be received. The indication of the fluid production rate can be for the at least one production zone within the wellbore, and the indication can occur while one or more additional fluids are being produced from the production zone(s). In some embodiments, the fluid can be an aqueous fluid or a gas, and the hydrocarbon fluid can comprise a liquid hydrocarbon.

In addition to the production rates, at least one operating parameters such as pressure or a derivative thereof (e.g., a rate of change of pressure, a force on the production face, etc.) can also be measured during the production of the hydrocarbon fluid and the fluid. For example, at step 156 an indication of the pressure within the at least one production zone can be received. The production rates and the indication of the pressure can be dynamic values that can be tracked over time. The resulting data set can represent a range of hydrocarbon production rates, fluid production rates, and operating parameters.

The resulting data set can be used to correlate the indication of the pressure with the hydrocarbon production rate and the fluid production rate at step 158. For example, a relationship between each of the variables can be determined to allow the fluid production rate to be controlled relative to the hydrocarbon production rate. For example, the operating parameter (e.g., pressure, drawdown pressure, rate of pressure change, force on the production face, etc.) can be controlled to control the relative amounts of the hydrocarbon fluid and fluid being produced from the at least one production zone. The operating envelope can then be determined at step 160 based on the correlation.

Using the operating envelope, the production of the fluids from the production zone and/or a plurality of production zones in the wellbore can be controlled using the operating envelope. In some embodiments, the operating parameter can be controlled over time to reduce the relative contribution of the fluid to the total fluid production rate while increasing the relative contribution of the hydrocarbon fluid to the total fluid production rate. For example, a ratio of the production rate of the hydrocarbon fluid to the production rate of the fluid can be increased by operating within the operating envelope.

Figure 4:
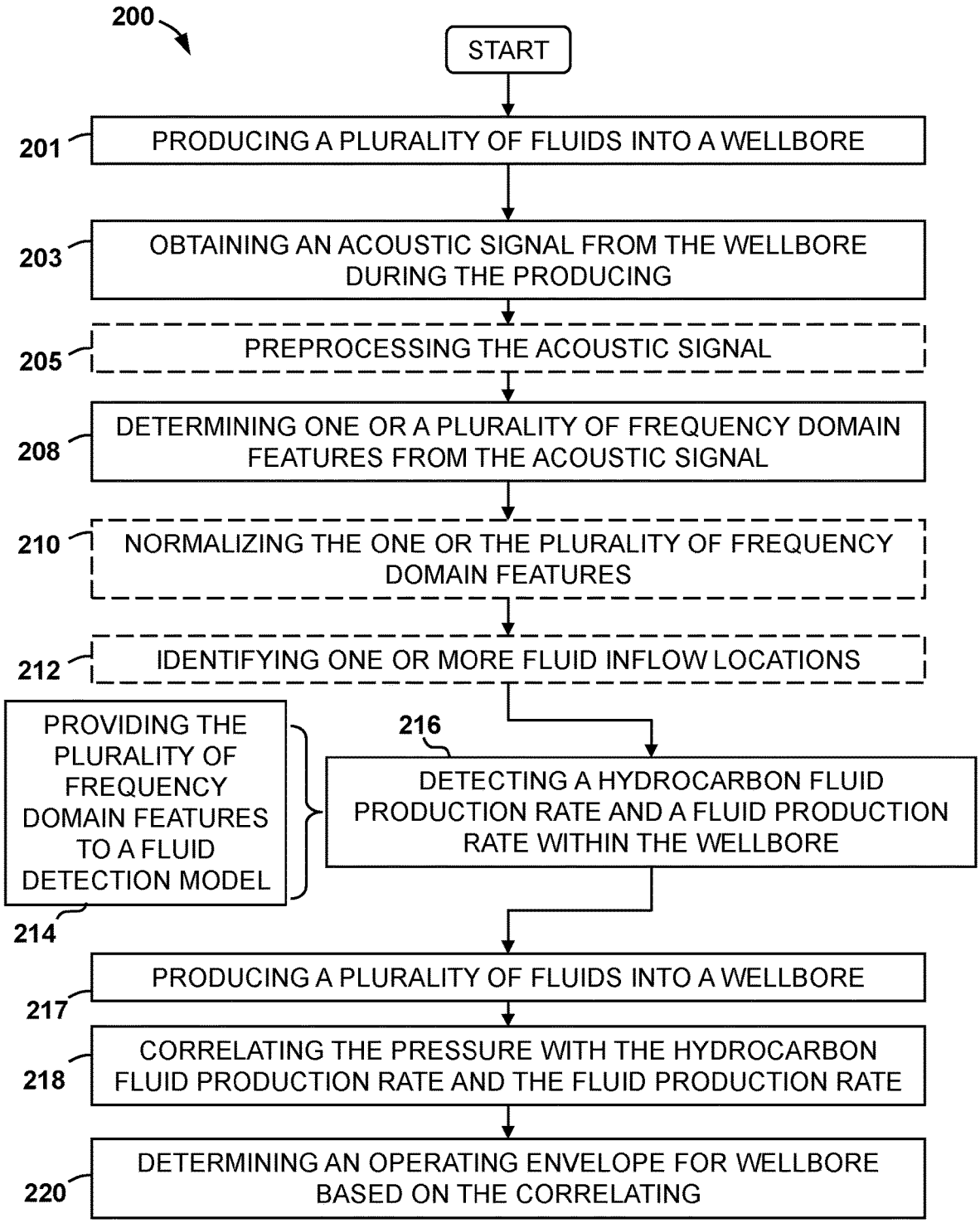
FIG. 4 is a flow diagram of a method of determining an operating envelope for a wellbore according to some embodiments.

The method 151 can be carried out using a variety of processes for determining the production rates, inflow phases and fluids, and fluid inflow locations. An exemplary process is shown in FIG. 4. Referring now to FIG. 4, a flow chart of a method 200 of determining an operating envelope for improving draw down in a wellbore is shown. As described herein, the described methods and related systems can be generally used to detect fluid inflows and flows. As used herein fluid flow can comprise fluid flow along or within a tubular within the wellbore such as fluid flow within a production tubular (e.g., production tubular 120 within wellbore 114). Fluid flow can also comprise fluid flow from the reservoir or formation into a wellbore tubular and/or an annular space between the wellbore tubular and the formation face. Such flow into the wellbore and/or a wellbore tubular can also be referred to as fluid inflow in some contexts. While fluid inflow may be separately identified at times in this disclosure, such fluid inflow is considered a part of fluid flow within the wellbore.

Generally speaking, the method 200 may comprise producing one or more fluids into a wellbore at 201, obtaining an acoustic signal along the wellbore at 203, and determining one or a plurality of frequency domain features from the acoustic signal at 208, detecting a fluid inflow and/or fluid flow within the wellbore using the plurality of frequency domain features at 216 (e.g., including fluid identification, phase identification, etc.), correlating an operating parameter with the fluid inflow and/or fluid flow at 218, and determining an operating envelope for based on the correlating at 220. In some embodiments, method 200 includes identifying one or more fluid inflow locations at 212. In some embodiments, method 200 includes identifying the fluid inflow and/or fluid flow at the one or more fluid inflow locations using the plurality of frequency domain features at 216. In some embodiments method 200 may comprise preprocessing the acoustic signal at 205 prior to determining one or more of the plurality of frequency domain features from the acoustic signal at 208. In addition, in some embodiments, method 200 may optionally comprise normalizing one or more of the plurality of frequency domain features at 210 and/or identifying the one or more fluid flow locations at 212 prior to identifying the hydrocarbon production rate and/or fluid production rate at 216. The above noted features of method 200 are now described in more detail below.

Initially, method 200 includes producing a plurality of fluids into a wellbore at 201, including at least a first fluid of interest such as a hydrocarbon fluid, and a second, undesirable fluid. Referring briefly again to FIG. 1, in some embodiments, producing the one or more fluids into the wellbore may comprise producing fluids into a wellbore 114 at one or more production zones 104*a*, 104*b* and flowing the produced fluids into and through a production tubular 120. As previously described above, the fluid produced at 201 may comprise a number of different components, such as, for instance, hydrocarbon liquids (e.g., oil), hydrocarbon gases (e.g., ethane, methane, propane, etc.), aqueous fluids (e.g., water, brine, etc.), and/or other fluids (e.g., carbon dioxide, etc.). In addition, as was also previously mentioned above, the one or more fluids produced into the wellbore at 201 may include sand or other particulate matter produced from the formation 102.

The method 200 can include obtaining an acoustic signal at 203. Such an acoustic signal can be obtained via any suitable method. For instance, the acoustic signal may be obtained utilizing a DAS system, such as, for instance the DAS system 110 shown in FIG. 1, in the manner previously described above.

After the acoustic signal is obtained at 203, method 200 may proceed, in some embodiments, to an optional pre-processing of the raw data at 205. The acoustic signal can be generated within the wellbore as previously described. Depending on the type of DAS system employed (e.g., DAS system 110 in FIG. 1), the optical data may or may not be phase coherent and may be pre-processed to improve the signal quality (e.g., denoised for opto-electronic noise normalization/de-trending single point-reflection noise removal through the use of median filtering techniques or even through the use of spatial moving average computations with averaging windows set to the spatial resolution of the acquisition unit, etc.). The raw optical data from the acoustic sensor can be received, processed, and generated by the sensor to produce the acoustic signal.

A number of specific optional pre-processing steps can be performed to determine the presence of fluid inflow (or flow), and to detect a sand ingress or sand transport within the detected fluid inflow (or flow). In some embodiments, a processor or collection of processors (e.g., processor 168 in FIG. 1) may be utilized to perform the preprocessing steps described herein. In some embodiments, the noise detrended "acoustic variant" data can be subjected to an optional spatial filtering step following the other pre-processing steps, if present. A spatial sample point filter can be applied that uses a filter to obtain a portion of the acoustic signal corresponding to a desired depth or depth range in the wellbore. Since the time the light pulse sent into the optical fiber returns as backscattered light can correspond to the travel distance, and therefore depth in the wellbore, the acoustic data can be processed to obtain a sample indicative of the desired depth or depth range. This may allow a specific location within the wellbore to be isolated for further analysis. The pre-processing at 205 may also include removal of spurious back reflection type noises at specific depths through spatial median filtering or spatial averaging techniques. This is an optional step and helps focus primarily on an interval of interest in the wellbore. For example, the spatial filtering step can be used to focus on a producing interval where there is high likelihood of sand ingress, for example. The resulting data set produced through the conversion of the raw optical data can be referred to as the acoustic sample data.

The optional pre-processing can also comprise filtering. Filtering can provide several advantages. For instance, when the acoustic data set is spatially filtered, the resulting data, for example the acoustic sample data, used for the next step of the analysis can be indicative of an acoustic sample over a defined depth (e.g., the entire length of the optical fiber, some portion thereof, or a point source in the wellbore 114). In some embodiments, the acoustic data set can comprise a plurality of acoustic samples resulting from the spatial filter to provide data over a number of depth ranges. In some embodiments, the acoustic sample may contain acoustic data over a depth range sufficient to capture multiple points of interest. In some embodiments, the acoustic sample data contains information over the entire frequency range of the detected acoustic signal at the depth represented by the sample. This is to say that the various filtering steps, including the spatial filtering, do not remove the frequency information from the acoustic sample data.

Preprocessing at 205 can further comprise calibrating the acoustic signal. Calibrating the acoustic signal can comprise removing a background signal from the acoustic signal, aligning the acoustic data with physical depths in the wellbore, and/or correcting the acoustic signal for signal variations in the measured data. In some embodiments, calibrating the acoustic signal comprises identifying one or more anomalies within the acoustic signal and removing one or more portions of the acoustic signal outside the one or more anomalies.

Preprocessing at 205 can optionally include a noise normalization routine to improve the signal quality. This step can vary depending on the type of acquisition device used as well as the configuration of the light source, the sensor, and the other processing routines. The order of the aforementioned preprocessing steps can be varied, and any order of the steps can be used.

Following the preprocessing at 205, method 200 may determine one or a plurality of frequency domain features from the acoustic signal at 208. In some embodiments, the filtered data can be transformed from the time domain into the frequency domain using a transform. For example, Discrete Fourier transformations (DFT) or a short time Fourier transform (STFT) of the acoustic variant time domain data measured at each depth section along the fiber or a section thereof may be performed to provide the data from which the plurality of frequency domain features can be determined. The frequency domain features can then be determined from the acoustic data. Within this process, various frequency domain features can be calculated for the acoustic sample data, including any of those described herein.

The use of frequency domain features to identify inflow locations, inflow phase discrimination, and flow rate classification (e.g., for fluid inflow/flow) can provide a number of advantages. For example, the use of the frequency domain features can, with the appropriate selection of one or more of the frequency domain features, provide a concise, quantitative measure of the spectral character or acoustic signature of specific sounds pertinent to downhole fluid surveillance and other applications.

While a number of frequency domain features can be determined for the acoustic sample data, not every frequency domain feature may be used in the identifying fluid flow characteristics, inflow locations, flow type, sand ingress/transport detection, or flow rate classification or prediction. The frequency domain features represent specific properties or characteristics of the acoustic signals. There are a number of factors that can affect the frequency domain feature selection for each fluid inflow event. For example, a chosen descriptor should remain relatively unaffected by the interfering influences from the environment such as interfering noise from the electronics/optics, concurrent acoustic sounds, distortions in the transmission channel, and the like. In general, electronic/instrumentation noise is present in the acoustic signals captured on the DAS or any other electronic gauge, and it is usually an unwanted component that interferes with the signal. Thermal noise is introduced during capturing and processing of signals by analogue devices that form a part of the instrumentation (e.g., electronic amplifiers and other analog circuitry). This is primarily due to thermal motion of charge carriers. In digital systems additional noise may be introduced through sampling and quantization. The frequency domain features should have values that are significant for a given event in the presence of noise.

As a further consideration in selecting the frequency domain feature(s) for a fluid inflow and flow detection in some embodiments, the dimensionality of the frequency domain feature should be compact. A compact representation may be desired to decrease the computational complexity of subsequent calculations. It may also be desirable for the frequency domain feature to have discriminant power. For example, for different types of audio signals, the selected set of descriptors should provide altogether different values. A measure for the discriminant power of a feature is the variance of the resulting feature vectors for a set of relevant input signals. Given different classes of similar signals, a discriminatory descriptor should have low variance inside each class and high variance over different classes. The frequency domain feature should also be able to completely cover the range of values of the property it describes.

Referring still to FIG. 4, as previously described in some embodiments method 200 may optionally comprise normalizing the one or the plurality of frequency domain features at 210 and/or then identifying the one or more fluid inflow locations at 212 prior to detecting the fluid inflows and/or fluid flows at 216. As shown in FIG. 4, in some embodiments, the method 200 may proceed to optionally identifying the one or more fluid inflow locations at 212 without first normalizing the frequency domain features at 210. The one or more fluid inflow locations at 212 may be determined via other data, knowledge or experience as known to those of having ordinary skill. For instance, in some embodiments, the one or more fluid inflow locations may be determined via PLS data at 212. In some embodiments, the one or more fluid inflow locations at 212 are determined as described hereinbelow.

For example, in some embodiments, block 212 may comprise identifying the one or more fluid flow and/or inflow locations using one or more of the frequency domain features to identify acoustic signals corresponding to the flow and/or inflow, and correlating the depths of those signals with locations within the wellbore. The one or more frequency domain features can comprise at least two different frequency domain features in some embodiments. In some embodiments, the one or more frequency domain features utilized to determine the one or more fluid inflow locations comprises at least one of a spectral centroid, a spectral spread, a spectral roll-off, a spectral skewness, an RMS band energy, a total RMS energy, a spectral flatness, a spectral slope, a spectral kurtosis, a spectral flux, a spectral autocorrelation function, as well as combinations, transformations, and/or normalized variant(s) thereof.

In some embodiments, block 212 of method 200 may comprise: identifying a background fluid flow signature using the acoustic signal; and removing the background fluid flow signature from the acoustic signal prior to identifying the one or more fluid inflow locations. In some embodiments, identifying the one or more fluid inflow locations comprises identifying one or more anomalies in the acoustic signal using the one or more frequency domain features of the plurality of frequency domain features; and selecting the depth intervals of the one or more anomalies as the one or more inflow locations. When a portion of the signal is removed (e.g., a background fluid flow signature, etc.), the removed portion can also be used as part of the event analysis. Thus, in some embodiments, identifying the one or more fluid inflow locations at block 212 comprises: identifying a background fluid flow signature using the acoustic signal; and using the background fluid flow signature from the acoustic signal to identify an event such as one or more fluid flow events.

Without being limited to this or any other theory, identifying one or more fluid inflow locations at 212 may be useful for identifying the locations within the wellbore in which fluid inflow can occur. Thus, further analysis to determine whether fluid inflow is occurring and the type of fluids present in the inflow may be focused on these identified locations so as to potentially reduce processing power and data collection during operations.

Referring still to FIG. 4, in some embodiments, method 200 comprises detecting fluid inflow and production rates within the wellbore (e.g., an inflow and/or a fluid flow within a wellbore) using a plurality of frequency domain features at 216. In some embodiments, method 200 may progress to block 216 immediately following block 208 or following blocks 210 and/or 212 as previously described above and shown in FIG. 4. Thus, in some embodiments block 216 may comprise detecting the fluid inflow and/or determining fluid production rates of the plurality of fluids using the plurality of frequency domain features, which can occur with or without any previously identified one or more fluid inflow locations from 212. In some embodiments, the plurality of frequency domain features utilized at block 216 may comprise one more of the frequency domain features described herein including combinations, variants (e.g., a normalized variant), and/or transformations thereof. For instance, in some embodiments, at least two such frequency domain features (and/or combinations, variants, or transformations thereof) are utilized at block 216. In some embodiments, the frequency domain features utilized within block 216 may comprise a ratio between at least two of the plurality of the frequency domain features.

In some embodiments, block 216 of method 200 may comprise providing the plurality of frequency domain features to a fluid inflow event detection model (e.g., a logistic regression model) at 214 and detecting fluid inflows and/or fluid rates within the wellbore based on the fluid inflow event detection model. In some embodiments, the fluid inflow event detection model can be developed using and/or may include machine learning such as a neural network, a Bayesian network, a decision tree, a logistical regression model, or a normalized logistical regression, or other supervised learning models. In some embodiments, the model at 214 may define a relationship between at least two of the plurality of the frequency domain features, including in some embodiments combinations, variations, and/or transformations of the frequency domain features and the presence or occurrence of fluid inflow and/or fluid inflow production rates, including phase identification and/or component identification within the fluid inflows. Thus, the fluid inflow event detection model at block 214 may comprise a multivariate model in which the two or more frequency domain features are variables that may be provided by acoustic data (e.g., such as acoustic data obtained from DAS system 110 as previously described above). Thus, the fluid inflow event detection model may utilize one or more (e.g., at least two) of the frequency domain features as inputs therein. In some embodiments, block 216 (e.g., including block 214) may comprise utilizing the plurality of frequency domain features at the identified one or more fluid inflow locations (e.g., such as at the production zones 104*a*, 104*b* shown in FIG. 1) in the fluid inflow event detection model and then comparing the plurality of frequency domain features to an output of the model(s); and detecting a fluid inflow event based on the comparison(s).

The fluid inflow event detection model at 214 may be configured to detect fluid inflows and/or fluid inflow rates in different fluid phases through different types of production assemblies, pipes, annuli, and the like. In some embodiments, the fluid inflow event detection model at 214 may be trained to detect the fluid inflow events. Specifically, acoustic data from a known fluid flow (e.g., one in which the type, phase, and amount of fluid therein is known or otherwise determined) can be used in the fluid inflow event detection model development process to determine one or more multivariate models indicative of an inflowing fluid in one or more fluid phases and/or in a flowing fluid within the wellbore within one or more fluid phases. Such multivariate models may then be used with detected acoustic data at 214 and 216 to determine if fluid inflow is occurring within the wellbore, and if so, a production rate of the fluid(s).

In some embodiments, the fluid inflow event detection model at 214 may define one or more event signatures based on selected frequency domain features (or combinations, transformations, or variants thereof). For instance, a fluid inflow event detection model may define a first event signature for ingress hydrocarbon fluid inflow from one or more production zones (e.g., productions zones 104*a*, 104*b* in FIG. 1), and a second event signature for a different fluid inflow along the wellbore. In some embodiments, the fluid inflow event detection model may define a plurality of fluid inflow signatures for determining if fluid is flowing into the wellbore at multiple locations and/or under multiple fluid flow conditions. Similarly, the fluid inflow event detection model may define a plurality of fluid flow signatures for determining the types of fluid and/or fluid phases flowing or being transported within different portions of the wellbore. Thus, during operations, the frequency domain features from the obtained acoustic signal may be compared against the predetermined event signatures, and a determination may be made that the particular event(s) are occurring if the selected frequency domain features substantially correspond with the event signature (e.g., the frequency domain features or combinations, variants, transformations thereof are within a threshold range, are greater than, equal to, or less than a predetermined decision threshold, etc. defined by the event signature, etc.).

In some embodiments, the fluid inflow event detection model at 214 may not only be configured to detect the presence of fluid inflow within the wellbore, but may also be configured to determine or detect an amount or flow rate of the fluids and/or fluid phases associated with the detected fluid inflow(s). In some embodiments, a multivariate model (or a set of multivariate models) may then be utilized to determine an amount, or production rate of the fluid that is associated with a given (e.g., detected) fluid inflow event. In some embodiments, the multivariate model(s) may utilize a plurality of frequency domain features (e.g., such as at least two frequency domain features) as inputs to determine a production rate or amount of each of one or more fluids. For instance, the multivariate model(s) may classify the production rate or amount of a hydrocarbon fluid into one or more predetermined ranges or buckets based on a plurality of decision boundaries that are dependents upon chosen sets or groups of frequency domain features. Thus, by applying the obtained acoustic data to the second multivariate model(s), one may determine whether a given fluid production falls within a plurality of predetermined production rate ranges (e.g., such as a low, medium, and high range having preselected production rate boundaries).

In some embodiments, the detection of the fluid inflow (e.g., a hydrocarbon fluid inflow, a fluid inflow, etc.) may occur while simultaneously producing one or more fluids additional fluids into and/or from the wellbore (e.g., hydrocarbon liquids, water, hydrocarbon gas, etc.). The components and/or flow rates of the one or more fluids may also be determined via a multivariate model which may be substantially similar to the fluid inflow event detection model described above. In particular, in some embodiments, one or more multivariate models (e.g., logistic regression models) may utilize one or more frequency domain features (as well as combinations, variants, and/or transformations thereof) to detect a fluid inflow/flow, determine the one or more fluids within the fluid inflow/flow, and/or to classify or calculate the flow rates of the detected fluids of the one or more fluids.

In addition, in some embodiments, the one or more fluids produced into and/or from the wellbore may be detected and/or characterized via other methods that do not employ the use of multivariate models having frequency domain features as inputs. For example, machine learning models can be used in place of multivariate models. In some embodiments, the detection and characterization (e.g., including fluid types and flow rates therefor) may be determined and/or correlated with an analysis of fluids emitted from the wellbore at or near the surface.

At step 217, an operating parameter can be determined while the fluid inflow and/or fluid production rates are determined within the wellbore. The operating parameter can be an absolute pressure, a drawdown pressure, or a derivative of the pressure such as a force on the production face of the wellbore or a rate of pressure change. In some embodiments, the operating parameter may be measured (e.g., particularly any one or more of the parameters listed above) with a pressure monitoring system comprising one or more pressure sensors disposed within the wellbore (e.g., such as pressure monitoring system 130 in FIG. 1). For instance, each of the above listed parameters for measuring the force on the production face may be determined, inferred, or directly measured at least partially through monitoring of a downhole pressure (e.g., wellbore pressure, a production zone pressure, formation pressure, drawdown pressure, etc.) via a pressure monitoring system as described herein.

The fluid monitoring process as described with respect to step 216 and the operating parameter determination in step 217 can be dynamic measurements in some embodiments. For example, the measurements can take place under actual production conditions, and the detection can track dynamic changes and reactions between the different types of fluid inflows and production rates along with the operating parameters. This can provide inflow and production rate data over a range of inflow rates and pressures to allow for a range of the operating envelope to be determined.

Referring still to FIG. 4, after detecting the fluid inflows and/or fluid production rates within wellbore at 216 and the operating parameter at 217, the method 200 proceeds to correlate an operating parameter such as the pressure, drawdown pressure, rate of change or pressure, and/or force on the production face with the detected fluid inflow and/or fluid inflow rates (e.g., the hydrocarbon production rates, the fluid production rates, etc.) at 218. Thus, in some embodiments, the correlating at block 218 may comprise correlating one or more of the operating parameters described herein to the fluid production rates. In some embodiments, the correlation at block 218 may comprise correlating a plurality of (i.e., two or more) of the operating parameters as described herein with the fluid production rates.

In some embodiments, the operating parameter correlated with the hydrocarbon fluid inflow and the fluid inflow can comprise a force on the production face. The force on the production face can include, but is not limited to, a flux of the one or more fluids through the at least one production face of the wellbore, or an acceleration of the one or more fluids between a reservoir and an interior of the wellbore at the production face of the at least one production zone. The flux of the one or more fluids through the production face refers to an amount of fluid passing through an area defined by the production face within the production zone per time period. The flux can be measured using flow rate measurements obtained from the DAS or other sensors along with known geometric parameters of the wellbore and production face. The flux provides a measure of the force on the face of the formation by relating the amount of fluid being drawn across the face over time. In general, a larger fluid flow across the face of the formation (and thus a high flux) per each unit of time correlates to a larger force on the production face of the wellbore. The rate of change of the flux can also affect the amount of sand where a larger change in the flux (e.g., a larger increase in the flux) can result in a higher rate of sanding.

Similarly, an acceleration of the one or more fluids between the reservoir and the interior of the wellbore can be measured using flow and/or pressure measurements within a production zone. The acceleration of the one or more fluids can be related to a force on the formation wall, which can affect the rate of fluid inflow into the wellbore.

In some embodiments, the correlating at block 218 may comprise constructing a look up table and/or a mathematical relationship and/or model. In some embodiments, the correlating at block 218 may comprise constructing a plurality of look up tables and/or a plurality of mathematical relationships and/or models.

In addition, in some embodiments, the correlating at block 218 may comprise constructing a fluid inflow prediction model that correlates the fluid inflow(s) (including the fluid inflow rate(s) per fluid type and/or phase as described above) with the operating parameter or parameters. Thus, the fluid inflow prediction model may receive input (at least partially) from the output of the fluid inflow detection model described above (e.g., such as the fluid inflow events and/or rates).

In some embodiments, the fluid inflow prediction model can be developed using and/or may include machine learning such as a neural network, a Bayesian network, a decision tree, a logistical regression model, or a normalized logistical regression, or other supervised learning models. In some embodiments, the fluid inflow prediction model may predict a fluid inflow and/or fluid inflow rates based on a production rate of the one or more fluids from the production zone of the wellbore and/or the operating parameter(s) as described above. In some embodiments, the fluid inflow prediction model may predict a fluid inflow and/or fluid inflow rate(s) based on one or more reservoir properties of the production zone either in lieu of or in addition to the other parameters described above. In some embodiments the one or more reservoir features may comprise porosity, permeability, a measure of consolidation of a formation material, a type of formation material, or any combination or variant thereof.

After correlating the operating parameter with the production rate of the one or more fluids including the hydrocarbon fluid and the additional fluid, method 200 proceeds to determine an operating envelope based on the correlating at 220. The operating envelop can define a boundary for the operating parameter (e.g., the pressure or a derivative thereof), the hydrocarbon production rate, and the fluid production rate. In some embodiments, the operating envelope may be defined by an upper limit which may define a maximum pressure or derivative thereof that does not also cause or result in excessive fluid production or at least results in fluid production below a predetermined threshold. The predetermined threshold can represent an absolute production rate of the fluid, a relative production rate of the fluid, and/or a ratio of the production rate of the hydrocarbon fluid to the production rate of the fluid.

The operating envelope may provide for minimum and maximum values of one or more of these particular parameters during production operations for the wellbore. For instance, in some embodiments, the operating parameter may comprise an absolute pressure, a drawdown pressure, or a rate of pressure change within the production zone (e.g., productions zones 104*a*, 104*b* in FIG. 1). Without being limited to this or any other theory, the absolute pressure, the drawdown pressure, and/or a rate of pressure change in the production zone of the well (and thus also a rate of drawdown pressure change) may drive the flux and/or acceleration of fluids through the production zone of the well during production operations. Thus, as the operating parameter changes (e.g., as the drawdown pressure increases), the flux and acceleration of the fluids within the production zone toward and into the wellbore may increase (e.g., production zones 104*a*, 104*b* in FIG. 1) into the wellbore. Therefore, the operating envelope determined at 220 may provide range of values for the operating parameter such as the pressure and derivatives thereof that may avoid sand ingress within the wellbore. In some embodiments, a boundary, such as for instance an upper boundary or limit, of the operating envelope may be a function of at least one of a pressure and/or a production rate of the one of more fluids from the production zone(s) (e.g., production zones 104*a*, 104*b* in FIG. 1).

In some embodiments, the upper limit of the operating envelope may comprise a limit of the operating parameter such as a drawdown pressure, above which an increase or a relative increase in the fluid production rate relative to the hydrocarbon production rate may occur. In some embodiments, the upper limit of the operating envelope may comprise a limit of drawdown pressure, above which the production rate of the fluid may rise above a predetermined maximum threshold value. For instance, a wellbore operator may choose to allow or accept some amount or rate of fluid production along with the hydrocarbon production during operations. This limit may be based on the capacity of surface handling equipment or the like. In some embodiments, an acceptable amount or rate of fluid production may comprise an amount or rate of fluid inflow that may be passed through the flow paths and/or production equipment of the wellbore without (or without significant, appreciable, or otherwise unacceptable) wear or damage thereto.

In some embodiments, the operating envelope may be defined by a lower limit which may define a minimum amount of production (that is an amount or rate of the one or more fluids described above) from the wellbore. The minimum amount of production from the wellbore may be defined by economics. Specifically, the minimum amount of production may comprise a minimum amount of produced fluids that may provide sufficient revenue to offset a cost of maintaining and producing the wellbore. In some embodiments, the minimum amount of production may be a minimum amount of production to prevent other problems or issues. For instance, the minimum amount of production may comprise a minimum amount or flow rate that will sufficiently lift liquid (e.g., water) from the wellbore such that water loading of the wellbore may be prevented or at least delayed. In some embodiments, the minimum amount of production can be zero or substantially zero.

In some embodiments, the operating envelope may be determined at block 220 utilizing the fluid inflow prediction model developed at 218. Thus, the fluid inflow prediction model may provide an operating envelope for the operating parameter such as pressure that may provide an acceptable amount or rate of fluid inflow from the wellbore.

In some embodiments, a processor (e.g., processor 168 in FIG. 1) or other controller may be coupled to a choke valve or other pressure adjustment mechanism of the wellbore. Thus, during operations, the processor may automatically make adjustments to the position of the choke so as to maintain the well within the operating envelope. For instance, if a well operator desires to increase a drawdown pressure of the well, the processor may automatically adjust the position of the choke valve to achieve the desired drawdown pressure while maintaining the operating parameter (e.g., drawdown pressure, rate of change of pressure, etc.) within the operating envelope so as to avoid or at least limit fluid inflow from the production zones of the wellbore.

In some embodiments, following the determination of the operating envelope at 220, method 200 may include updating or refining the operating envelope based on subsequently acquired data or observations (e.g., such as subsequently acquired acoustic signals as previously described above). In particular, in some embodiments, following block 220, the operating envelope may be updated by: detecting the fluid inflow and/or fluid inflow rates (e.g., the hydrocarbon production rate, the fluid production rate, etc.) over a second time interval and then correlating the detected production rate(s) of fluids produced during the second time period with an operating parameter such as pressure via the procedures previously described above (e.g., via blocks 201-218 in FIG. 4). Thereafter, the operating envelope may be updated or re-determined entirely based on the newly performed correlating.

Thus, through use of method 200, a well operator may determine an operating envelope for operating (e.g., producing from) a subterranean wellbore while limiting or avoiding the production of fluids with a desired fluid such as a hydrocarbon fluid. In some embodiments, a well operator may utilize the operating envelope to determine a drawdown pressure, a production rate of one or more fluids, and/or an absolute wellbore pressure (or other operational parameters) that will limit the production of undesirable fluids during operations. In many instances, a well operator may wish to operate the wellbore at a limit of the drawdown pressure, absolute wellbore pressure, production rate that is associated with an upper limit of the operating envelope, so as to maximize potential production from the well (e.g., the production of hydrocarbon liquids and/or gases). Accordingly, the operating envelope may facilitate a maximum amount of production from the wellbore while still avoiding the equipment damage and/or plugging that is typically associated with the production of undesirable fluids.

In some embodiments, an operating envelope and/or a fluid inflow prediction model developed for a first wellbore or one or more production zones therein may be utilized to determine an operating window for a second wellbore or one or more production zones therein. The second wellbore may be a second wellbore extending through the same subterranean formation as the first wellbore, or may be a second wellbore that extends through a different, and possibly remote, subterranean formation from the subterranean formation of the first wellbore. This may be advantageous as it may allow an operating envelope to be defined for a wellbore without obtaining fluid inflow detection measurements from that particular wellbore (e.g., such as via the DAS system 110 of FIG. 1). Thus, a second wellbore may be operated within an operating envelope so as to limit fluid inflow of a fluid along with a hydrocarbon fluid as previously described above. For instance, reference is now made to FIG. 5 which shows a method 300 of determining an operating envelope for a second wellbore, based on predetermined operating envelopes from one or more first wellbores according to some embodiments.

Initially, method 300 includes determining operating envelopes for the production zone(s) of one or more first wellbores at 302. The operating envelopes may be selected so as to limit or reduce the production of fluids with hydrocarbon fluids from the production zone into the first wellbore from the corresponding production zone(s). Thus, in some embodiments, the operating envelopes may be determined for the production zones of the one or more first wellbores by applying the systems and methods (e.g., described above), such as, in particular the fluid inflow monitoring system 110 and the method 151 and/or 200. Accordingly, in some embodiments, the operating envelopes may be derived from fluid inflow prediction models for the production zone(s) of each of the one or more first wellbores in the manner previously described above (see e.g., method 151 in FIG. 3 and method 200 in FIG. 4).

In some embodiments, an operating envelope may be determined for a single production zone (e.g., production zones 104*a*, 104*b*) of a single first wellbore at 302. In some embodiments, operating envelopes may be determined for production zone(s) (e.g., a single production zone or multiple production zones) for a plurality of first wellbores. The plurality of first wellbores may extend into a single reservoir, or some or all of the first wellbores may extend into different reservoirs. Thus, at block 302, operating envelopes (and fluid inflow predictions models) may be developed for one or a plurality of first wellbores (including potentially multiple production zones within each of the first wellbores).

Figure 5:
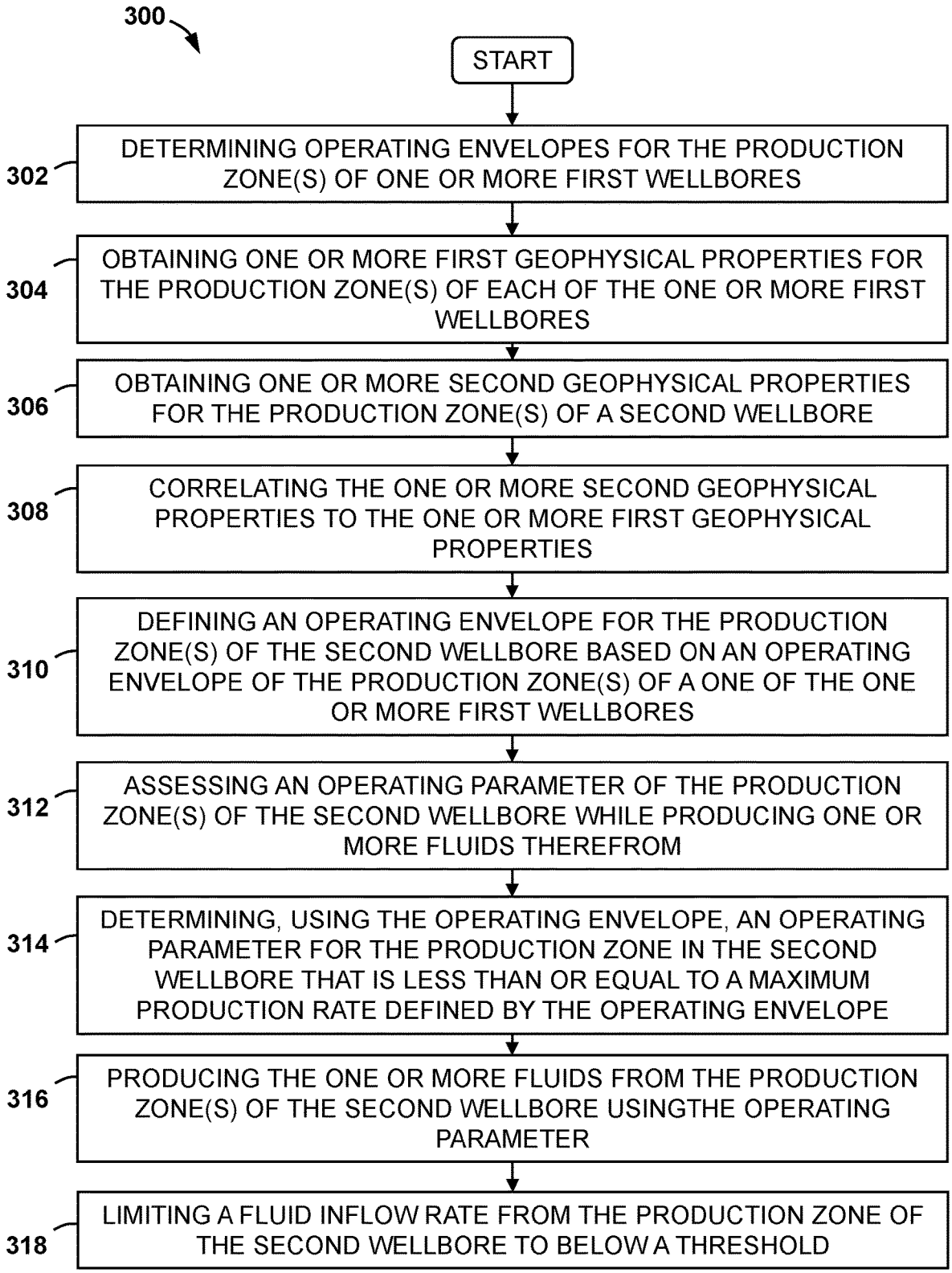
FIG. 5 is a flow diagram of a method of determining an operating envelope for a second wellbore, based on predetermined operating envelopes from one or more first wellbores according to some embodiments.

Referring still to FIG. 5, in addition to determining the operating envelopes for the production zone(s) of the one or more first wellbores at 302, method 300 also includes obtaining one or more first reservoir properties for the production zone(s) of each of the one or more first wellbores at 304. The one or more first reservoir properties can comprise geophysical properties, reservoir models and model properties, seismic maps, fault lines, fracture information, and the like. The geophysical properties may include any suitable rock properties, reservoir properties, fluid properties, etc. associated with the production zone(s) of the one or more first wellbores. For instance, the one or more geophysical properties may include one or more of porosity, permeability, a measure of consolidation of a formation material, a type of formation material, or any combination or variant thereof. The one or more first geophysical properties may be obtained via any suitable method including, for example, direct measurement by sensors, testing (e.g., such as core sample testing), observation during production, drilling, completion, or other wellbore operations, etc. The reservoir models and model properties can comprise data indicative of a model of the formation. the reservoir models can be used to predict fluid flow through the formation and the location, orientation, and composition of various layers throughout the formation. the seismic maps can be similar to reservoir models and can contain data on the formation and formation layers themselves. Similarly, the fault lines and fracture information can comprise specific information on flow paths within the formation and can be obtained from various seismic surveys, reservoir models and the like.

The obtained one or more first reservoir properties may be associated with the production zone(s) of the one or more first wellbores as well as the operating envelopes (and underlying fluid inflow prediction models) previously determined for the production zone(s) of the one or more first wellbores. As previously described above, in some embodiments the fluid inflow prediction models that were constructed to determine the operating envelopes of the production zone(s) of the one or more first wellbores may utilize at least some of the one or more reservoir properties as a variable therein. Thus, in blocks 302, 304 the operating envelopes may each be associated with a corresponding set of the one or more first reservoir properties and vice versa. In embodiments where a plurality of operating envelopes are determined for the production zone(s) of a plurality of first wellbores, a catalogue or matrix may be constructed whereby the plurality of operating envelopes (including the underlying plurality of fluid inflow prediction models) are indexed by the one or more first reservoir properties. Thus, by searching this catalogue based on one or more reservoir properties of interest, one may obtain one or more operating envelopes (and/or fluid inflow prediction models) that correspond with the search criteria.

Method 300 also includes obtaining one or more reservoir properties from the production zone(s) of a second wellbore (e.g., second reservoir properties, etc.). The second wellbore may be different from each of the one or more first wellbores. For instance, the second wellbore may be a different wellbore extending into the same reservoir as at least one of the one or more first wellbores, or the second wellbore may extend into a different reservoir than all of the one or more first wellbores. As used herein, the first reservoir properties and the second reservoir properties can be the same properties through the values as defined by the first and second reservoir properties may vary between the two wellbores. For example, the one or more second reservoir properties of the production zone(s) of the second wellbore may include any or all of the same reservoir properties described above for the one or more first reservoir properties, and may be obtained, derived, inferred, measured, etc. via any of the methods described above. It should be appreciated that the one or more reservoir properties may be obtained prior to actually forming (e.g., drilling) and/or completing the second wellbore.

Once the one or more second reservoir properties of the production zone(s) of the second wellbore are obtained at 306, method 300 proceeds to correlate the one or more second reservoir properties to the one or more first reservoir properties. For instance, in some embodiments, block 306 may comprise comparing the one or more second reservoir properties to the one or more first reservoir properties. The comparison may be made so as to determine whether the one or more second reservoir properties correspond with the one or more first reservoir properties. For instance, the comparison may comprise determining whether the one or more second reservoir properties are within a predetermined range (e.g., +/−20%, +/−10%, +/−5%, +/−1%, etc.) of the one or more first reservoir properties. In embodiments where the one or more first reservoir properties are obtained for a plurality of first wellbores, the one or more second reservoir properties may be compared against some or all of the sets of the one or more first reservoir properties for each of the one or more first wellbores so as to determine which (if any) of the sets of one or more first reservoir properties corresponds (or best corresponds) to the one or more second reservoir properties according to previously determined criteria (e.g., such as that previously described). The correlation of the properties can be used to identify similar producing layers within a single reservoir, or similar producing layers in different reservoirs.

Once the one or more second reservoir properties are correlated to the one or more first reservoir properties at 308, method 300 proceeds to determine an operating envelope for the production zone(s) of the second wellbore based on an operating envelope of the production zone(s) of a one of the one or more first wellbores having the one or more first reservoir properties that correspond with the one or more second reservoir properties at 310. In particular, block 310 may comprise applying the operating envelope (and potentially the fluid inflow prediction model utilized to originally derive the operating envelope) of the production zone(s) of a particular one of the one or more first wellbores that has one or more first reservoir properties that correspond (e.g., via the example criteria described above) with the one or more second reservoir properties. Without being limited to this or any other theory, if the reservoir properties of two wellbores (or production zones within the two wellbores) correspond in the manner described above, it may be assumed that the behavior of the two wellbores (or at least the two production zones) may be the same or at least comparable. Thus, an operating envelope for a first of the two corresponding wellbores may be applied to provide an applicable operating envelope for the second of the two corresponding wellbores.

In some embodiments, the operating envelope for the first wellbore can be modified based on any differences in properties identified in the second of the two wellbores, which can help to adjust for differences between the wellbores. The modifications can take into account differences in the rock properties to tailor the operating envelope to the producing zone in the second wellbore. Using data across various producing zones can allow for the types of modifications to be determined and applied to the correlated operating envelopes.

For some embodiments where operating envelopes and one or more first reservoir properties are obtained for a plurality of first wellbores at blocks 302 and 304, respectively, blocks 308 and 310 may comprise searching a database or catalogue of the operating envelopes (and sand prediction models) utilizing the obtained one or more second reservoir properties of the second wellbore, and returning a list of operating envelopes or a single operating envelope that is associated with the one or more reservoir properties that correspond, based on predetermined criteria as explained above, to the provided one or more second reservoir properties.

In some embodiments, a different operating envelope may be defined for some or all of the production zones of the second wellbore at block 310. Each operating envelope may be determined based on an operating envelope of a production zone of one of the first wellbores in which the one or more first reservoir properties correspond with the one or more second reservoir properties of the particular production zone of the second wellbore. Thus, in some embodiments the operating envelopes of at least some of the production zones of the second wellbore may be defined by operating envelopes from different ones of the first wellbores.

Referring still to FIG. 5, method 300 also includes determining an operating parameter such as pressure, drawdown pressure, rate of change of pressure, and/or a force on the production face of the second wellbore while producing fluids (e.g., a hydrocarbon fluid, and at least one second fluid) therefrom at 312. As previously described, the pressure or derivations thereof may be measured or characterized by a number of different parameters. As is also described above, many (or all) of the above described parameters for measuring and/or characterizing the force on the production face of a production zone may be determined, measured, inferred, etc. via a pressure monitoring system including one or more pressure sensors disposed within the wellbore (e.g., such as pressure monitoring system 130 in FIG. 1). Therefore, at block 312, method may comprise taking one or more pressure measurements within the second wellbore via a suitable pressure monitoring system to assess the force on the production face of the production zone(s) therein during production of one or more fluids therefrom (e.g., hydrocarbons liquids, hydrocarbon gases, water, etc.).

After the operating envelope is defined at 310, method 300 also includes determining, using the defined operating envelope, an operating parameter for the production zone(s) of the second wellbore that is less than or equal to a maximum operating parameter defined by the operating envelope at 314. As previously described, a wellbore operator may wish to maximize the production rate from a given well so as to produce as much hydrocarbons (e.g., liquids and/or gases) therefrom as possible. However, producing a well at too high a production rate (or increasing the production rate too quickly) can cause or increase the production rate of an undesired fluid as previously described above. Therefore, by applying a maximum production rate as defined by the operating envelope, a wellbore operating may maximize production of the hydrocarbon fluid from the wellbore while limiting or reducing a relative proportion of the undesired fluid (e.g., an aqueous fluid, a gas, etc.).

Accordingly, method 300 also includes (in some embodiments), producing the one or more fluids from the production zone(s) of the second wellbore at the defined operating parameter at 316, and limiting the secondary fluid production rate from the production zone(s) of the second wellbore to below a threshold or boundary as a result of producing the one or more fluids at the production rate at 318. In some embodiments, the threshold can comprise an absolute production rate of the fluid and/or a relative proportion of the fluid in the total production from the producing zone(s). For example, the threshold can represent a ratio of the hydrocarbon production rate to the fluid production rate.

Accordingly, method 300 may be utilized to define operating envelope(s) for the production zone(s) of a second wellbore based on previously determined operating envelopes for production zone(s) in one or more first wellbores as described above. Therefore, an operating envelope may be determined for the production zone(s) of a second wellbore that does not have or employ a sand monitoring system (e.g., such as the DAS system 110 in FIG. 1).

In some embodiments, one or more of the blocks of method 300 may be carried out before the second wellbore is fully formed (e.g., drilled, completed, etc.). For instance, any one or more of blocks 302-310 and 314 may be performed prior to forming and/or completing second wellbore in some embodiments. In addition, following the completion of method 300, the defined operating window for the second wellbore may be updated in a similar manner to that described above. For instance, additional acoustic data may be obtained within the corresponding one of the one or more first wellbores (e.g., the corresponding one of the one or more wellbores as described for block 308, 310), and the corresponding operating envelope of the production zone(s) of the first wellbore may be updated in substantially the same manner as described above with respect to method 200 shown in FIG. 4. The updated operating envelope of the corresponding first wellbore may then be applied to the defined operating envelope of the second wellbore in a similar manner so that subsequent changes in the production rate may be made according to the updated envelope. In some embodiments, the additional acoustic data may be obtained from a third wellbore. In some of these embodiments, it may first be determined whether the production zone(s) of the third wellbore sufficiently correspond to the production zone(s) of the second wellbore in substantially the same manner as previously described above, prior to utilizing the acoustic data from the third wellbore to update the operating envelope of the second wellbore.

Figure 6:
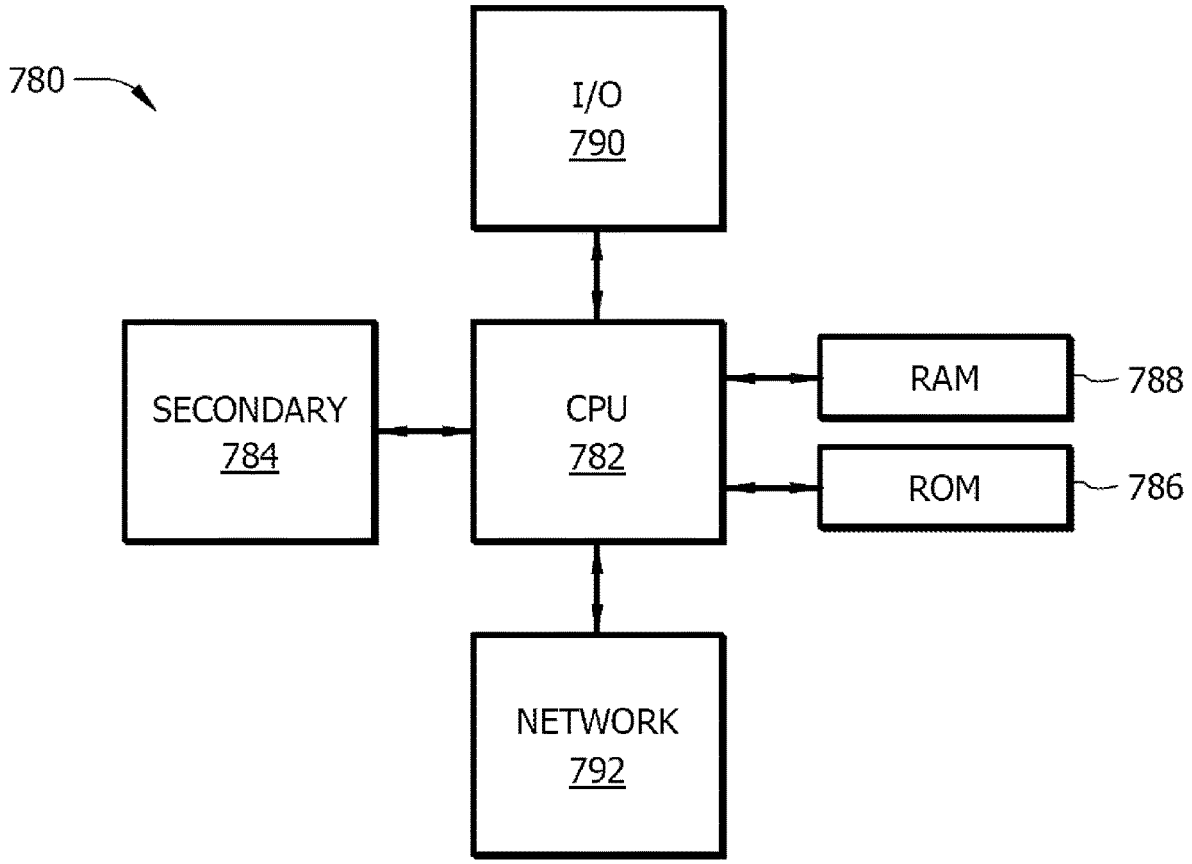
FIG. 6 schematically illustrates a computer that may be used to carry out various methods according to some embodiments.

Any of the systems and methods disclosed herein can be carried out on a computer or other device comprising a processor (e.g., a desktop computer, a laptop computer, a tablet, a server, a smartphone, or some combination thereof), such as the acquisition device 160 of FIG. 2. FIG. 6 illustrates a computer system 780 suitable for implementing one or more embodiments disclosed herein such as the acquisition device or any portion thereof. The computer system 780 includes a processor 782 (which may be referred to as a central processor unit or CPU) that is in communication with memory devices including secondary storage 784, read only memory (ROM) 786, random access memory (RAM) 788, input/output (I/O) devices 790, and network connectivity devices 792. The processor 782 may be implemented as one or more CPU chips.

It is understood that by programming and/or loading executable instructions onto the computer system 780, at least one of the CPU 782, the RAM 788, and the ROM 786 are changed, transforming the computer system 780 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 780 is turned on or booted, the CPU 782 may execute a computer program or application. For example, the CPU 782 may execute software or firmware stored in the ROM 786 or stored in the RAM 788. In some cases, on boot and/or when the application is initiated, the CPU 782 may copy the application or portions of the application from the secondary storage 784 to the RAM 788 or to memory space within the CPU 782 itself, and the CPU 782 may then execute instructions of which the application is comprised. In some cases, the CPU 782 may copy the application or portions of the application from memory accessed via the network connectivity devices 792 or via the I/O devices 790 to the RAM 788 or to memory space within the CPU 782, and the CPU 782 may then execute instructions of which the application is comprised. During execution, an application may load instructions into the CPU 782, for example load some of the instructions of the application into a cache of the CPU 782. In some contexts, an application that is executed may be said to configure the CPU 782 to do something, e.g., to configure the CPU 782 to perform the function or functions promoted by the subject application. When the CPU 782 is configured in this way by the application, the CPU 782 becomes a specific purpose computer or a specific purpose machine.

The secondary storage 784 is typically comprised of one or more disk drives or tape drives and is used for non-volatile storage of data and as an over-flow data storage device if RAM 788 is not large enough to hold all working data. Secondary storage 784 may be used to store programs which are loaded into RAM 788 when such programs are selected for execution. The ROM 786 is used to store instructions and perhaps data which are read during program execution. ROM 786 is a non-volatile memory device which typically has a small memory capacity relative to the larger memory capacity of secondary storage 784. The RAM 788 is used to store volatile data and perhaps to store instructions. Access to both ROM 786 and RAM 788 is typically faster than to secondary storage 784. The secondary storage 784, the RAM 788, and/or the ROM 786 may be referred to in some contexts as computer readable storage media and/or non-transitory computer readable media.

I/O devices 790 may include printers, video monitors, electronic displays (e.g., liquid crystal displays (LCDs), plasma displays, organic light emitting diode displays (OLED), touch sensitive displays, etc.), keyboards, keypads, switches, dials, mice, track balls, voice recognizers, card readers, paper tape readers, or other well-known input devices.

The network connectivity devices 792 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards that promote radio communications using protocols such as code division multiple access (CDMA), global system for mobile communications (GSM), long-term evolution (LTE), worldwide interoperability for microwave access (WiMAX), near field communications (NFC), radio frequency identity (RFID), and/or other air interface protocol radio transceiver cards, and other well-known network devices. These network connectivity devices 792 may enable the processor 782 to communicate with the Internet or one or more intranets. With such a network connection, it is contemplated that the processor 782 might receive information from the network, or might output information to the network (e.g., to an event database) in the course of performing the above-described method steps. Such information, which is often represented as a sequence of instructions to be executed using processor 782, may be received from and outputted to the network, for example, in the form of a computer data signal embodied in a carrier wave.

Such information, which may include data or instructions to be executed using processor 782 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several known methods. The baseband signal and/or signal embedded in the carrier wave may be referred to in some contexts as a transitory signal.

The processor 782 executes instructions, codes, computer programs, scripts which it accesses from hard disk, floppy disk, optical disk (these various disk based systems may all be considered secondary storage 784), flash drive, ROM 786, RAM 788, or the network connectivity devices 792. While only one processor 782 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 784, for example, hard drives, floppy disks, optical disks, and/or other device, the ROM 786, and/or the RAM 788 may be referred to in some contexts as non-transitory instructions and/or non-transitory information.

In an embodiment, the computer system 780 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 780 to provide the functionality of a number of servers that is not directly bound to the number of computers in the computer system 780. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 780, at least portions of the contents of the computer program product to the secondary storage 784, to the ROM 786, to the RAM 788, and/or to other non-volatile memory and volatile memory of the computer system 780. The processor 782 may process the executable instructions and/or data structures in part by directly accessing the computer program product, for example by reading from a CD-ROM disk inserted into a disk drive peripheral of the computer system 780. Alternatively, the processor 782 may process the executable instructions and/or data structures by remotely accessing the computer program product, for example by downloading the executable instructions and/or data structures from a remote server through the network connectivity devices 792. The computer program product may comprise instructions that promote the loading and/or copying of data, data structures, files, and/or executable instructions to the secondary storage 784, to the ROM 786, to the RAM 788, and/or to other non-volatile memory and volatile memory of the computer system 780.

In some contexts, the secondary storage 784, the ROM 786, and the RAM 788 may be referred to as a non-transitory computer readable medium or a computer readable storage media. A dynamic RAM embodiment of the RAM 788, likewise, may be referred to as a non-transitory computer readable medium in that while the dynamic RAM receives electrical power and is operated in accordance with its design, for example during a period of time during which the computer system 780 is turned on and operational, the dynamic RAM stores information that is written to it. Similarly, the processor 782 may comprise an internal RAM, an internal ROM, a cache memory, and/or other internal non-transitory storage blocks, sections, or components that may be referred to in some contexts as non-transitory computer readable media or computer readable storage media.

Having described various systems and methods herein, certain embodiments can provide for the determination and use of an operating envelope, and the application of operating envelopes across wellbores. Certain embodiments related to developing and using an operating envelope can include, but are not limited to:

In a first embodiment, a method for determining an operating envelope for a wellbore comprises: receiving an indication of a hydrocarbon production rate of a hydrocarbon fluid into the wellbore from at least one production zone, while producing one or more fluids from the wellbore from the at least one production zone; receiving an indication of a fluid production rate of a fluid into the wellbore from the at least one production zone while producing the one or more fluids from the wellbore from the at least one production zone, wherein the fluid production rate comprises at least one of an aqueous fluid production rate or a gas production rate; receiving an indication of a pressure within the wellbore while producing the one or more fluids from the wellbore from the at least one production zone; correlating the indication of the pressure with the hydrocarbon production rate and the fluid production rate; and determining an operating envelope based on the correlating, wherein the operating envelope defines a boundary for the indication of the pressure, the fluid production rate, and the hydrocarbon production rate.

A second embodiment can include the method of the first embodiment, wherein the indication of the pressure is taken within the at least one production zone.

A third embodiment can include the method of the first or second embodiment, wherein the indication of the pressure comprises at least one of: an absolute pressure within the at least one production zone, a rate of pressure change within the at least one production zone, or a force on the production face within the at least one production zone.

A fourth embodiment can include the method of the third embodiment, wherein the force on the production face of the at least one production zone of the wellbore is measured by at least one of a flux of the one or more fluids through the at least one production face of the wellbore, or an acceleration of the one or more fluids between a reservoir and an interior of the wellbore at the production face of the at least one production zone.

A fifth embodiment can include the method of any one of the first to fourth embodiments, further comprising: controlling the hydrocarbon production rate from the wellbore within the operating envelope based on controlling the absolute pressure, the rate of pressure change, or the force on the production face.

A sixth embodiment can include the method of any one of the first to fifth embodiments, wherein the hydrocarbon fluid comprises oil, and wherein the fluid comprises an aqueous phase stream.

A seventh embodiment can include the method of any one of the first to sixth embodiments, further comprising: detecting the indication of the hydrocarbon production rate, or the indication of the fluid production rate using an acoustic monitoring system disposed within the wellbore.

An eighth embodiment can include the method of the seventh embodiment, wherein detecting the indication of the hydrocarbon production rate, or the indication of the fluid production rate using the acoustic monitoring system comprises: detecting an acoustic signal along the wellbore using a fiber optic cable disposed within the wellbore; comparing a hydrocarbon inflow signature with the acoustic signal to produce a first output; comparing a fluid production signature with the acoustic signal to produce a second output; and detecting the indication of the hydrocarbon production rate, the indication of the fluid production rate, or both based on the first output and the second output.

A ninth embodiment can include the method of any one of the first to eighth embodiments, further comprising: controlling the production rate of the hydrocarbon from the wellbore within the operating envelope based on the detecting of the fluid production rate from the at least one production zone.

A tenth embodiment can include the method of any one of the first to eighth embodiments, further comprising: detecting, with a pressure monitoring system, a pressure within the wellbore while producing the one or more fluids and while detecting the indication of the hydrocarbon production rate, or the indication of the fluid production rate, or both.

An eleventh embodiment can include the method of the tenth embodiment, wherein the pressure monitoring system comprises a distributed pressure sensors system.

A twelfth embodiment can include the method of the tenth or eleventh embodiment, further comprising: monitoring a pressure in each of the at least one production zones with the pressure monitoring system.

A thirteenth embodiment can include the method of any one of the tenth to twelfth embodiments, further comprising: detecting the indication of the hydrocarbon production rate, or the indication of the fluid production rate, or both over a second time interval during production of the one or more fluids from the wellbore; detecting, with the pressure monitoring system, a pressure within the wellbore during the second time interval while producing the one or more fluids and while detecting the indication of the hydrocarbon production rate, or the indication of the fluid production rate, or both; correlating the indication of the pressure with the indication of the hydrocarbon production rate, or the indication of the fluid production rate, or both during the second time interval; and re-determining the operating envelope based on the correlating, wherein the one or more fluids are produced within the re-determined operating envelope after the second time interval.

A fourteenth embodiment can include the method of any one of the first to thirteenth embodiments, wherein the boundary for the operating envelope is a function of at least one of an absolute pressure within the wellbore or the production rate of the fluids from the least one production zone.

A fifteenth embodiment can include the method of any one of the first to fourteenth embodiments, wherein the at least one production zone comprises at least two production zones, and wherein the operating envelope is different between the at least two production zones.

A sixteenth embodiment can include the method of any one of the first to fifteenth embodiments, further comprising: increasing the hydrocarbon production rate from the least one production zone while remaining within the operating envelope.

A seventeenth embodiment can include the method of any one of the first to sixteenth embodiments, further comprising: automatically controlling the hydrocarbon production rate; and increasing a ratio of the hydrocarbon production rate to the fluid production rate in response to automatically controlling the force on the production face.

An eighteenth embodiment can include the method of the sixteenth or seventeenth embodiment, wherein increasing the hydrocarbon production rate comprises producing the hydrocarbon fluid at a maximum production rate while remaining within the operating envelope.

In a nineteenth embodiment, a system for determining an operating envelope for a wellbore comprises: a monitoring assembly configured to detect one or more values related to the wellbore; a processor, wherein the processor is configured to execute an analysis program to: receive, from the monitoring assembly, a sensor signal, wherein the sensor signal is generated while producing one or more fluids from at least one production zone within the wellbore; receive an indication of a hydrocarbon production rate of a hydrocarbon fluid from the at least one production zone using the sensor signal; receive an indication of indication of a fluid production rate of a fluid using the sensor signal; receive an indication of a pressure within the wellbore; correlate the indication of the pressure with the hydrocarbon production rate and the fluid production rate; and determine an operating envelope based on the correlation, wherein the operating envelope defines a boundary for the indication of the pressure, the fluid production rate, and the hydrocarbon production rate.

A twentieth embodiment can include the system of the nineteenth embodiment, wherein the indication of the pressure comprises at least one of an absolute pressure within the at least one production zone, a rate of pressure change within the at least one production zone, or a force on the production face within the at least one production zone.

A twenty first embodiment can include the system of the twentieth embodiment, further comprising: controlling the hydrocarbon production rate from the wellbore within the operating envelope based on controlling the absolute pressure, the rate of pressure change, or the force on the production face.

A twenty second embodiment can include the system of any one of the nineteenth to twenty first embodiments, wherein the force on the production face of the at least one production zone of the wellbore is measured by at least one of: a flux of the one or more fluids through the at least one production face of the wellbore, or an acceleration of the one or more fluids between a reservoir and an interior of the wellbore at the production face of the at least one production zone.

A twenty third embodiment can include the system of any one of the nineteenth to twenty second embodiments, wherein the hydrocarbon fluid comprises oil, and wherein the fluid comprises an aqueous phase stream.

A twenty fourth embodiment can include the system of any one of the nineteenth to twenty third embodiments, further comprising an acoustic monitoring system; wherein the acoustic monitoring system comprises: a fiber optic cable disposed in the wellbore; a receiver in signal communication with the fiber optical cable, wherein the sensor signal comprises an acoustic signal, and wherein the receiver is configured to use a light pulse to detect an acoustic signal within the wellbore along the length of the fiber optic cable; wherein the processor is configured to detect the hydrocarbon production rate, the fluid production rate, or both by executing the analysis program to: detect the acoustic signal using the fiber optic cable disposed within the wellbore; compare a hydrocarbon production signature with the acoustic signal to produce a first output; compare a fluid production signature with the acoustic signal to produce a second output; and detect the hydrocarbon production rate, the fluid production rate, or both based on the first output and the second output.

A twenty fifth embodiment can include the system of any one of the nineteenth to twenty sixth embodiments, wherein the monitoring assembly comprises a pressure monitoring system configured to detect the pressure within the wellbore, wherein the processor is configured to execute the analysis program to receive, from the pressure sensor, an indication of the pressure within the at least one production zone in the wellbore.

A twenty sixth embodiment can include the system of any one of the nineteenth to twenty fifth embodiments, wherein the processor is further configured to execute the analysis program to generate a control signal configured to increase the production rate of the hydrocarbon fluid while remaining within the operating envelope.

A twenty seventh embodiment can include the system of the twenty sixth embodiment, wherein the processor is configured to execute the analysis program to generate the control signal automatically and automatically control the production rate of the hydrocarbon fluid.

A twenty eighth embodiment can include the system of any one of the nineteenth to twenty seventh embodiments, wherein the processor is further configured to execute the analysis program to: monitor and detect the fluid production rate into the wellbore using the sensor signal during production from the wellbore; and control the hydrocarbon production rate from the wellbore within the operating envelope based on the detection of the fluid from the at least one production zone.

A twenty ninth embodiment can include the system of the twenty eighth embodiment, wherein the processor is configured to execute the analysis program to control the hydrocarbon production rate at a maximum hydrocarbon production rate of the one or more fluids within the operating envelope.

In a thirtieth embodiment, a method of controlling a drawdown pressure in a wellbore comprises: producing one or more hydrocarbon fluid from a wellbore at a first production rate; increasing a production of the hydrocarbon fluid from the first production rate to a second production rate, wherein the first production rate is less than the second production rate, wherein the production rate increase is maintained within an operating envelope, wherein the operating envelope defines a boundary between a pressure within the wellbore, a hydrocarbon production rate of the hydrocarbon fluid, and a fluid production rate of a fluid from a production zone in the wellbore; and limiting the fluid production rate of the fluid into the wellbore during the pressure increase based on maintaining the pressure within the operating envelope.

A thirty first embodiment can include the method of the thirtieth embodiment, wherein increasing the production of hydrocarbon fluid increases a ratio of the hydrocarbon production rate to the fluid production rate.

A thirty second embodiment can include the method of the thirtieth or thirty first embodiment, wherein the indication of the pressure comprises at least one of: an absolute pressure within the at least one production zone, a rate of pressure change within the at least one production zone, or a force on the production face within the at least one production zone.

A thirty third embodiment can include the method of the thirty second embodiment, wherein the force on the production face of the at least one production zone of the wellbore is measured by at least one of a flux of the one or more fluids through the at least one production face of the wellbore, or an acceleration of the one or more fluids between a reservoir and an interior of the wellbore at the production face of the at least one production zone.

A thirty fourth embodiment can include the method of any one of the thirtieth to thirty third embodiments, further comprising: controlling the hydrocarbon production rate from the wellbore within the operating envelope based on controlling the absolute pressure, the rate of pressure change, or the force on the production face.

A thirty fifth embodiment can include the method of any one of the thirtieth to thirty fourth embodiments, wherein the hydrocarbon fluid comprises oil, and wherein the fluid comprises an aqueous phase stream.

Certain embodiments related to developing and using an operating envelope across wellbores can include, but are not limited to:

In a first embodiment, a method comprises: obtaining one or more first reservoir properties of a first production zone within a first wellbore; correlating the one or more first reservoir properties with a set of reservoir properties having a corresponding set of determined operating envelopes; defining an operating envelope for the first production zone based on the determined operating envelope of the set of determined operating envelopes that corresponds to the first reservoir properties; determining, using the operating envelope, a pressure within the first production zone in the first wellbore that is less than or equal to a maximum pressure for the first production zone defined by the operating envelope, wherein: wherein the operating envelope defines a boundary between the pressure, a fluid production rate of a fluid, and a hydrocarbon production rate of a hydrocarbon, wherein the fluid production rate comprise at least one of: an aqueous fluid production rate or a gas production rate; and reducing a ratio of the fluid production rate to the hydrocarbon production rate in response to producing the one or more fluids from the first production zone at a pressure within the operating envelope.

A second embodiment can include the method of the first embodiment, further comprising: assessing the pressure within the first production zone during the production of one or more fluids; and determining, using the operating envelope, a hydrocarbon production rate for the first production zone in the first wellbore that is less than or equal to a maximum hydrocarbon production rate defined by the operating envelope, wherein the hydrocarbon fluid is produced from the first production zone at the production rate.

A third embodiment can include the method of the second embodiment, wherein the operating envelope is determined by: receiving an indication of a dynamic production rate of the hydrocarbon fluid and the fluid using a monitoring system disposed within the second wellbore, wherein the production of the hydrocarbon fluid and the fluid occurs while producing the one or more fluids from the second wellbore from the second production zone; receiving one or more second reservoir properties of the second production zone, wherein the second reservoir properties correspond to the first reservoir properties of the first production zone; receiving a pressure within the second wellbore while producing the one or more fluids and detecting the dynamic production rate of the hydrocarbon fluid and the fluid; correlating a pressure in the second production zone with the dynamic production rate of the hydrocarbon fluid and the fluid; and determining the operating envelope based on the correlating.

A fourth embodiment can include the method of the third embodiment, wherein receiving the indication of the dynamic production rate of the hydrocarbon fluid and the fluid using the monitoring system comprises: receiving an acoustic signal originating along the second wellbore using a fiber optic cable disposed within the second wellbore; comparing a hydrocarbon fluid production signature with the acoustic signal to produce a first output; comparing a fluid production signature with the acoustic signal to produce a second output; and determining the dynamic production rate of the hydrocarbon fluid and the fluid based on the first output and the second output.

A fifth embodiment can include the method of any one of the first to fourth embodiments, wherein the pressure comprises at least one of an absolute pressure within the at least one production zone, a rate of pressure change within the at least one production zone, or a force on the production face within the at least one production zone.

A sixth embodiment can include the method of the fifth embodiment, wherein the force on the production face of the at least one production zone of the wellbore is measured by at least one of a flux of the one or more fluids through the at least one production face of the wellbore, or an acceleration of the one or more fluids between a reservoir and an interior of the wellbore at the production face of the at least one production zone.

A seventh embodiment can include the method of the fifth or sixth embodiment, further comprising: controlling the hydrocarbon production rate from the wellbore within the operating envelope based on controlling the absolute pressure, the rate of pressure change, or the force on the production face.

An eighth embodiment can include the method of any one of the first to seventh embodiments, wherein the production rate of the hydrocarbon fluid is the maximum production rate defined by the operating envelope.

A ninth embodiment can include the method of any one of the first to eighth embodiments, wherein the first wellbore does not comprise a monitoring system.

A tenth embodiment can include the method of any one of the first to ninth embodiments, further comprising: determining, using a pressure monitoring system, a pressure within the second production zone of the second wellbore, wherein the pressure monitoring system comprises a distributed pressure sensors system.

An eleventh embodiment can include the method of any one of the first to tenth embodiments, further comprising: receiving the indication of the dynamic production rate of the hydrocarbon fluid and the fluid over a first time interval during production of the one or more fluids from the second wellbore; receiving a pressure within the wellbore during the first time interval while producing the one or more fluids and detecting the dynamic production rate of the hydrocarbon fluid and the fluid; correlating the pressure in the second wellbore during the first time interval; and re-determining the operating envelope based on the correlating, wherein the hydrocarbon fluids is produced at a production rate within the re-determined operating envelope after the first time interval.

In a twelfth embodiment, a system comprises: a processor and a memory storing an analysis program, wherein the processor is configured to execute the analysis program to: receive one or more first reservoir properties of a first production zone within a first wellbore; correlate the one or more first reservoir properties with a set of reservoir properties having corresponding set of determined operating envelopes; define an operating envelope for the first production zone based on the determined operating envelope of the set of determined operating envelopes that corresponds to the first reservoir properties; determine, using the operating envelope, an operating pressure for the first production zone in the first wellbore that is less than or equal to a maximum operating pressure defined by the operating envelope, wherein the operating envelope defines a boundary between the pressure, a fluid production rate of a fluid, and a hydrocarbon production rate of a hydrocarbon, and generate an output with one or more parameters configured to allow the one or more fluids to be produced from the first production zone at the production rate, wherein a ratio of the fluid production rate to the hydrocarbon production rate is reduced in response to producing the one or more fluids from the first production zone at a pressure within the operating envelope.

A thirteenth embodiment can include the system of the twelfth embodiment, wherein the processor is further configured to: asses the operating pressure within the first production zone during the production of the one or more fluids; and determine, using the operating envelope, a hydrocarbon production rate for the first production zone in the first wellbore that is less than or equal to a maximum hydrocarbon production rate defined by the operating envelope.

A fourteenth embodiment can include the system of the twelfth or thirteenth embodiment, further comprising: a monitoring system disposed within a second wellbore; and a pressure monitoring system configured to detect a pressure within the second wellbore, wherein the processor is further configured to execute the analysis program to: receive a signal from the monitoring system; detect, using the signal from the monitoring system, the hydrocarbon production rate in the second wellbore, and the fluid production rate in the second wellbore, wherein the detection of the hydrocarbon production rate in the second wellbore, and the fluid production rate in the second wellbore occurs while one or more fluids are produced from the second production zone, and wherein the second production zone has one or more second reservoir properties corresponding to the one or more first reservoir properties of the first production zone; receive a pressure output from the pressure monitoring system; detect, based on the pressure output, the operating pressure within the second production zone; correlate of the operating pressure in the second production zone with a production rate of the hydrocarbon fluid and the fluid from the second production zone; and determine the operating envelope based on the correlating.

A fifteenth embodiment can include the system of the fourteenth embodiment, wherein the monitoring system comprises a fiber optic cable disposed within the second wellbore, where the signal from the monitoring system comprises an indication of an acoustic signal generated within the second wellbore.

A sixteenth embodiment can include the system of any one of the twelfth to fifteenth embodiments, wherein the hydrocarbon production rate is the maximum hydrocarbon production rate defined by the operating envelope.

A seventeenth embodiment can include the system of any one of the twelfth to sixteenth embodiments, wherein the first wellbore does not comprise a fluid monitoring system.

An eighteenth embodiment can include the system of any one of the twelfth to seventeenth embodiments, further comprising: a pressure monitoring system configured to detect a pressure within the second wellbore, wherein the processor is further configured to execute the analysis program to: determine, based on a signal from the pressure monitoring system, a pressure within the second production zone, wherein the pressure monitoring system comprises a distributed pressure sensors system.

A nineteenth embodiment can include the system of any one of the twelfth to eighteenth embodiments, wherein the pressure comprises at least one of an absolute pressure within the at least one production zone, a rate of pressure change within the at least one production zone, or a force on the production face within the at least one production zone.

A twentieth embodiment can include the system of the nineteenth embodiment, wherein the force on the production face of the at least one production zone of the wellbore is measured by at least one of a flux of the one or more fluids through the at least one production face of the wellbore, or an acceleration of the one or more fluids between a reservoir and an interior of the wellbore at the production face of the at least one production zone.

A twenty first embodiment can include the system of the nineteenth or twentieth embodiment, further comprising: controlling the hydrocarbon production rate from the wellbore within the operating envelope based on controlling the absolute pressure, the rate of pressure change, or the force on the production face.

The embodiments disclosed herein have included systems and methods for detecting and/or characterizing sand ingress and/or sand transport within a subterranean wellbore, or a plurality of such wellbores. Thus, through use of the systems and methods described herein, one may more effectively limit or avoid sand ingress and accumulation with a wellbore so as to enhance the economic production therefrom.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for determining an operating envelope for a wellbore, the method comprising:

receive an acoustic signal originating within the wellbore, wherein the acoustic signal is detected using an acoustic sensor within the wellbore;

comparing a hydrocarbon inflow signature with the acoustic signal to produce a first output;

comparing a fluid production signature with the acoustic signal to produce a second output; and detecting an indication of a hydrocarbon production rate, an indication of a fluid production rate, or both based on the first output and the second output;

receiving the indication of the hydrocarbon production rate of a hydrocarbon fluid into the wellbore from at least one production zone, while producing one or more fluids from the wellbore from the at least one production zone;

receiving the indication of the fluid production rate of a fluid into the wellbore from the at least one production zone while producing the one or more fluids from the wellbore from the at least one production zone, wherein the fluid production rate comprises at least one of: an aqueous fluid production rate or a gas production rate;

receiving an indication of a pressure within the wellbore while producing the one or more fluids from the wellbore from the at least one production zone, wherein the indication of the pressure comprises at least one of a rate of pressure change within the at least one production zone or a force on the production face within the at least one production zone;

correlating the indication of the pressure with the hydrocarbon production rate and the fluid production rate; and determining an operating envelope based on the correlating, wherein the operating envelope defines a boundary for the indication of the pressure, the fluid production rate, and the hydrocarbon production rate, and wherein the operating envelope is applied to the at least one production zone.

2. The method of claim 1, wherein the indication of the pressure is taken within the at least one production zone.

3. The method of claim 2, wherein the indication of the pressure further comprises an absolute pressure within the at least one production zone, and wherein the force on the production face within the at least one production zone is measured by at least one of: a flux of the one or more fluids through the at least one production face of the wellbore, or an acceleration of the one or more fluids between a reservoir and an interior of the wellbore at the production face of the at least one production zone.

4. The method of claim 3, further comprising: controlling the hydrocarbon production rate from the wellbore within the operating envelope based on controlling the absolute pressure, the rate of pressure change, or the force on the production face.

5. The method of claim 1, wherein the hydrocarbon fluid comprises oil, and wherein the fluid comprises an aqueous phase stream.

6. The method of claim 1, further comprising:

detecting the acoustic signal along the wellbore using a fiber optic cable disposed within the wellbore.

7. The method of claim 1, further comprising: controlling the production rate of the hydrocarbon fluid from the wellbore within the operating envelope based on the detecting of the fluid production rate from the at least one production zone.

8. The method of claim 1, further comprising: detecting, with a distributed pressure monitoring system, a pressure within the wellbore while producing the one or more fluids and while detecting the indication of the hydrocarbon production rate, or the indication of the fluid production rate, or both.

9. The method of claim 8, further comprising: monitoring a pressure in each of the at least one production zones with the distributed pressure monitoring system.

10. The method of claim 8, further comprising:

detecting the indication of the hydrocarbon production rate, or the indication of the fluid production rate, or both over a second time interval during production of the one or more fluids from the wellbore;

detecting, with the pressure monitoring system, a pressure within the wellbore during the second time interval while producing the one or more fluids and while detecting the indication of the hydrocarbon production rate, or the indication of the fluid production rate, or both;

correlating the indication of the pressure with the indication of the hydrocarbon production rate, or the indication of the fluid production rate, or both during the second time interval; and re-determining the operating envelope based on the correlating, wherein the one or more fluids are produced within the re-determined operating envelope after the second time interval.

11. The method of claim 1, wherein the boundary for the operating envelope is a function of at least one of an absolute pressure within the wellbore or the production rate of the fluids from the least one production zone.

12. The method of claim 1, wherein the at least one production zone comprises at least two production zones, and wherein the operating envelope is different between the at least two production zones.

13. The method of claim 1, further comprising: increasing the hydrocarbon production rate to a maximum production rate from the least one production zone while remaining within the operating envelope.

14. The method of claim 1, further comprising:

automatically controlling the hydrocarbon production rate; and increasing a ratio of the hydrocarbon production rate to the fluid production rate in response to automatically controlling the force on the production face.

15. A system for determining an operating envelope for a wellbore, the system comprising:

a monitoring assembly configured to detect one or more values related to the wellbore, wherein the monitoring assembly comprises an acoustic monitoring system configured to detect an acoustic signal within the wellbore;

a processor, wherein the processor is configured to execute an analysis program to:

receive, from the monitoring assembly, a sensor signal, wherein the sensor signal is generated while producing one or more fluids from at least one production zone within the wellbore, wherein the sensor signal comprises the acoustic signal from the acoustic monitoring system;

compare a hydrocarbon production signature with the acoustic signal to produce a first output;

compare a fluid production signature with the acoustic signal to produce a second output;

detect an indication of a hydrocarbon production rate, an indication of a fluid production rate, or both based on the first output and the second output;

receive the indication of the hydrocarbon production rate of a hydrocarbon fluid from the at least one production zone;

receive indication of the fluid production rate of a fluid;

receive an indication of a pressure within the wellbore, wherein the indication of the pressure comprises at least one of a rate of pressure change within the at least one production zone or a force on the production face within the at least one production zone;

correlate the indication of the pressure with the hydrocarbon production rate and the fluid production rate; and determine an operating envelope based on the correlation, wherein the operating envelope defines a boundary for the indication of the pressure, the fluid production rate, and the hydrocarbon production rate, and wherein the operating envelope is applied to the at least one production zone.

16. The system of claim 15, wherein the indication of the pressure further comprises an absolute pressure within the at least one production zone, and wherein the force on the production face within the at least one production zone is measured by at least one of: a flux of the one or more fluids through the at least one production face of the wellbore, or an acceleration of the one or more fluids between a reservoir and an interior of the wellbore at the production face of the at least one production zone.

17. The system of claim 16, further comprising: controlling the hydrocarbon production rate from the wellbore within the operating envelope based on controlling the absolute pressure, the rate of pressure change, or the force on the production face.

18. The system of claim 15, wherein the hydrocarbon fluid comprises oil, and wherein the fluid comprises an aqueous phase stream.

19. The system of claim 15, wherein the acoustic monitoring system comprises:

a fiber optic cable disposed in the wellbore; and a receiver in signal communication with the fiber optical cable, wherein the sensor signal comprises the acoustic signal, and wherein the receiver is configured to use a light pulse to detect an acoustic signal within the wellbore along the length of the fiber optic cable.

20. The system of claim 15, wherein the monitoring assembly comprises a pressure monitoring system configured to detect the pressure within the wellbore, wherein the processor is configured to execute the analysis program to receive, from the pressure sensor, an indication of the pressure within the at least one production zone in the wellbore.

21. The system of claim 15, wherein the processor is further configured to execute the analysis program to generate a control signal configured to increase the production rate of the hydrocarbon fluid while remaining within the operating envelope.

22. The system of claim 21, wherein the processor is configured to execute the analysis program to generate the control signal automatically and automatically control the production rate of the hydrocarbon fluid.

23. The system of claim 15, wherein the processor is further configured to execute the analysis program to:

monitor and detect the fluid production rate into the wellbore from the at least one production zone using the sensor signal during production from the wellbore; and control the hydrocarbon production rate from the wellbore to a maximum hydrocarbon production rate of the one or more fluids within the operating envelope based on the detection of the fluid production rate into the wellbore from the at least one production zone.

24. A method of controlling a drawdown pressure in a wellbore, the method comprising:

producing one or more hydrocarbon fluids from a wellbore at a first production rate;

receive an acoustic signal originating within the wellbore while producing the one or more hydrocarbon fluids from the wellbore, wherein the acoustic signal is detected using an acoustic sensor within the wellbore;

comparing a hydrocarbon inflow signature with the acoustic signal to produce a first output;

comparing a fluid production signature with the acoustic signal to produce a second output; and detecting a hydrocarbon production rate, a fluid production rate or both based on the first output and the second output;

receiving an indication of a pressure within the wellbore while producing the one or more fluids from the wellbore from the at least one production zone;

increasing a production of the hydrocarbon fluid from the first production rate to a second production rate, wherein the first production rate is less than the second production rate, wherein the production rate increase is maintained within an operating envelope, wherein the operating envelope defines a boundary between the indication of pressure within the wellbore, the hydrocarbon production rate of the hydrocarbon fluid, and the fluid production rate of a fluid from a production zone in the wellbore, and wherein the indication of the pressure comprises at least one of a rate of pressure change within the at least one production zone or a force on the production face within the at least one production zone; and limiting the fluid production rate of the fluid into the wellbore during the pressure increase based on maintaining the pressure within the operating envelope.

25. The method of claim 24, wherein increasing the production of hydrocarbon fluid increases a ratio of the hydrocarbon production rate to the fluid production rate.

26. The method of claim 24, wherein the indication of the pressure further comprises an absolute pressure within the at least one production zone, and wherein the force on the production face within the at least one production zone is measured by at least one of: a flux of the one or more fluids through the at least one production face of the wellbore, or an acceleration of the one or more fluids between a reservoir and an interior of the wellbore at the production face of the at least one production zone.

27. The method of claim 26, further comprising: controlling the hydrocarbon production rate from the wellbore within the operating envelope based on controlling the absolute pressure, the rate of pressure change, or the force on the production face.

* * * * *